US011376617B2

(12) United States Patent
Barron et al.

(10) Patent No.: US 11,376,617 B2
(45) Date of Patent: Jul. 5, 2022

(54) SPRAY DEVICE AND METHODS OF ASSEMBLY AND USE

(71) Applicant: Alternative Packaging Solutions, LLC, New York, NY (US)

(72) Inventors: Brad Barron, New York, NY (US); Adam Moyo Harvey-Cook, Warwick (GB); Aled Meredydd James, Warwick (GB); Thomas Henry Thompson Louth, Warwick (GB); Matthew James Edwards, Warwick (GB)

(73) Assignee: Alternative Packaging Solutions, LLC, New York, NY (US)

( * ) Notice: Subject to any disclaimer, the term of this patent is extended or adjusted under 35 U.S.C. 154(b) by 0 days.

(21) Appl. No.: 17/605,619

(22) PCT Filed: May 5, 2020

(86) PCT No.: PCT/US2020/031496

§ 371 (c)(1),
(2) Date: Oct. 22, 2021

(87) PCT Pub. No.: WO2020/227308

PCT Pub. Date: Nov. 12, 2020

(65) Prior Publication Data

US 2022/0143639 A1 May 12, 2022

Related U.S. Application Data

(60) Provisional application No. 62/843,625, filed on May 6, 2019.

(51) Int. Cl.
*B05B 11/00* (2006.01)

(52) U.S. Cl.
CPC ..... *B05B 11/3038* (2013.01); *B05B 11/309* (2013.01); *B05B 11/3067* (2013.01)

(58) Field of Classification Search
CPC ..... B05B 11/3038; B05B 11/3067; B05B 11/309
See application file for complete search history.

(56) References Cited

U.S. PATENT DOCUMENTS 4,167,941 A 9/1979 Capra et al.
6,109,479 A * 8/2000 Ruckdeschel ..... A61M 15/0025 222/402.1

(Continued)

OTHER PUBLICATIONS

International Search Report dated Aug. 3, 2020 filed in PCT/US2020/031496.

*Primary Examiner* — Jeremy Carroll
(74) *Attorney, Agent, or Firm* — Rankin, Hill & Clark LLP

(57) ABSTRACT

A spray device includes a bottle portion, a sleeve, and an engine. The engine includes a spring that when compressed pressurizes a chamber containing a dispensable amount of fluid from the bottle portion. The sleeve and the engine are configured to be torquable onto the bottle without compressing the spring. Rotation of the sleeve relative to the bottle by a user pressurizes a chamber containing fluid from the bottle. Auditory and/or tactile feedback is provided to the user during rotation of the sleeve thereby allowing the user to select an amount of the fluid to be dispensed. The engine includes a main spring that when compressed pressurizes a chamber containing a dispensable amount of fluid from the bottle. The spring is enclosed between a cup and a cap, which have been fused together.

17 Claims, 32 Drawing Sheets

(56) References Cited

U.S. PATENT DOCUMENTS

| | | | | |
|---|---|---|---|---|
| 6,220,483 | B1 | 4/2001 | van der Heijden | |
| 6,708,852 | B2 * | 3/2004 | Blake | B05B 9/0883 222/383.2 |
| 8,286,837 | B1 * | 10/2012 | Blake | B05B 9/0883 222/383.2 |
| 8,720,746 | B2 * | 5/2014 | Blake | B05B 9/0883 222/336 |
| 9,415,401 | B2 * | 8/2016 | Blake | F04B 39/12 |
| 9,751,102 | B2 * | 9/2017 | Blake | F04B 39/123 |
| 10,151,692 | B2 * | 12/2018 | Blake | F04B 39/0005 |
| 2011/0084100 | A1 | 4/2011 | Welp | |
| 2011/0121037 | A1 | 5/2011 | Kakuta | |
| 2013/0264359 | A1 * | 10/2013 | Blake | B05B 9/0883 222/336 |
| 2016/0368633 | A1 | 12/2016 | Smith et al. | |
| 2017/0001208 | A1 | 1/2017 | Barenhoff et al. | |
| 2017/0144178 | A1 * | 5/2017 | Deng | B65D 47/20 |
| 2018/0200744 | A1 | 7/2018 | Aworth | |

* cited by examiner

SPRAY DEVICE AND METHODS OF ASSEMBLY AND USE

BACKGROUND

Known spray devices are often bulky, cumbersome, difficult to interpret, or incapable of bearing common force overloads. Consequently, there is a desire for a spray device with design features that reduce an overall size and weight of the spray device; manufacturing expediencies; maintaining function and remaining safe while withstanding loads such as "overcharge" torque and the long term loading from a loading spring; producing high quality sprays, and improving viscous spray quality by reducing pressure losses through the flow path; improving the number of times the device may be re-used; ensuring that the actuating mechanism is easily actuated by a user and returns reliably; and achieving a clean spray cut off without dribble.

BRIEF DESCRIPTION

According to one aspect, a spray device includes a bottle portion, a sleeve, and an engine. The engine includes a spring that when compressed pressurizes a chamber containing a dispensable amount of fluid from the bottle portion. The sleeve and the engine are configured to be torquable onto the bottle without compressing the spring.

According to another aspect, a spray device includes a bottle portion, a sleeve, and an engine. Rotation of the sleeve relative to the bottle by a user pressurizes a chamber containing fluid from the bottle. The sleeve is configured such that auditory and/or tactile feedback is provided to the user during rotation of the sleeve thereby allowing the user to select an amount of the fluid to be dispensed.

According to another aspect, a spray device includes a bottle, a sleeve, and an engine. The engine includes a spring that when compressed pressurizes a chamber containing a dispensable amount of fluid from the bottle. The spring is enclosed between a cup and a cap, which have been fused together.

DETAILED DESCRIPTION

Figure 1:
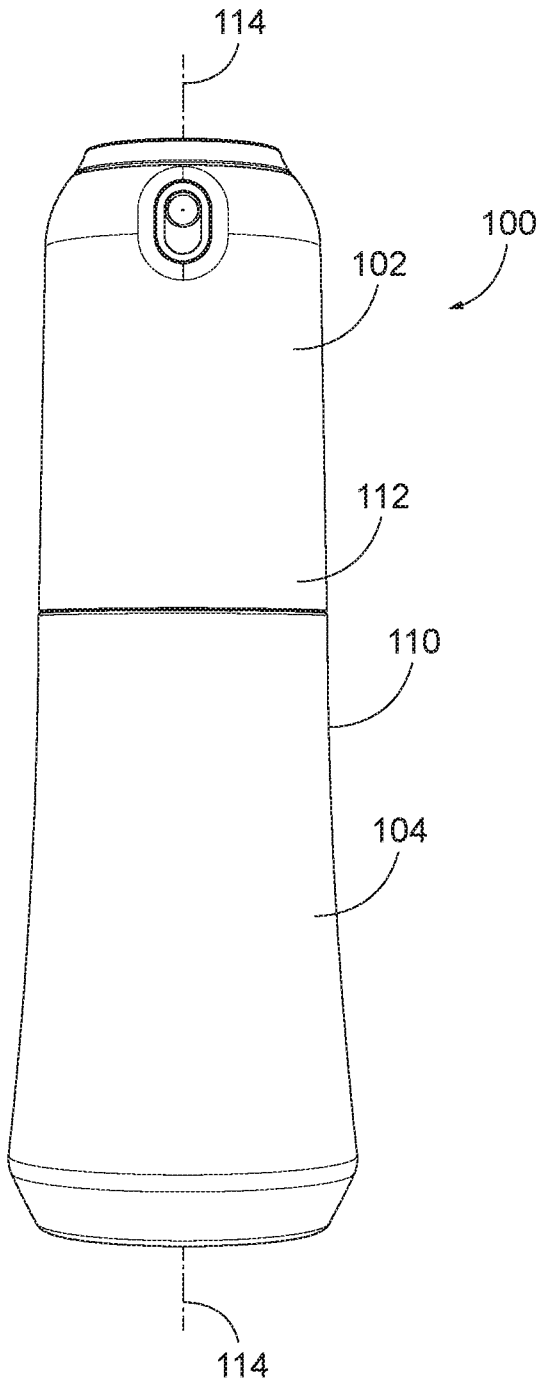
FIG. 1 is a front view of a spray device.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIG. 1 depicts a spray device 100 which includes a top portion 102 and a bottle portion 104. The spray device 100 includes a spray device exterior surface 110 that defines a substantially cylindrical profile taken from a front view as shown in FIG. 1. The top portion 102 includes a sleeve 112 configured for receiving the bottle portion 104 such that the top portion 102 is flush with the bottle portion 104. In this manner, the spray device exterior surface 110 is continuous between the top portion 102 and the bottle portion 104 when the bottle portion 104 is engaged with the top portion 102. The substantially cylindrical profile of the spray device exterior surface 110 defines a spray device longitudinal axis 114.

Figure 2:
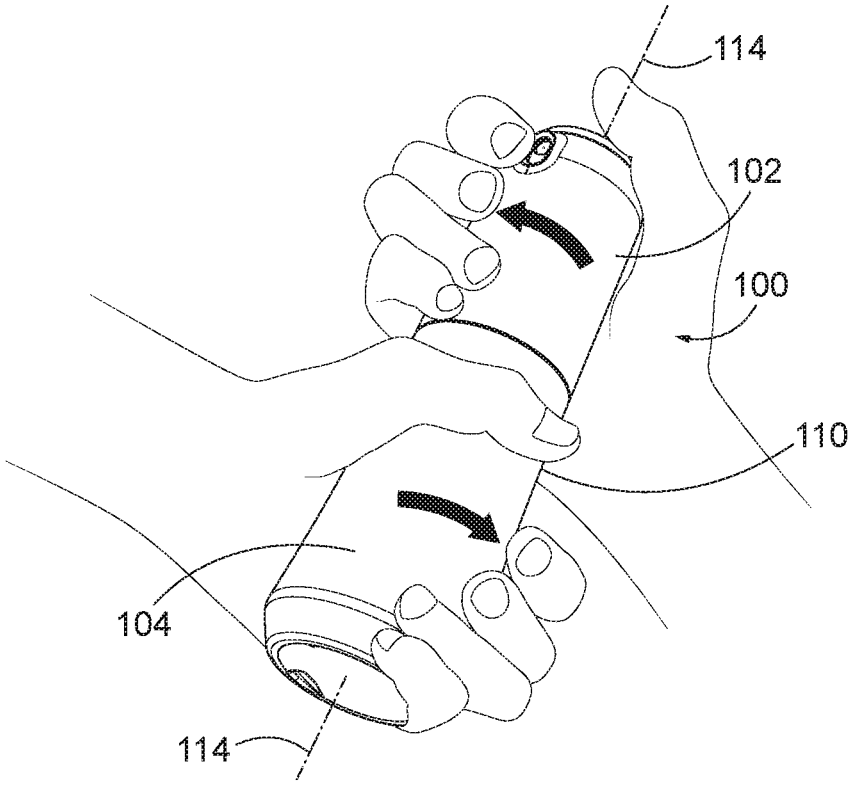
FIG. 2 is a perspective view of the spray device in a priming step.

The spray device 100 is configured to dispense liquid spray in a process that includes a priming step and a dispensing step. The priming step of the spray device 100 is depicted in FIG. 2, where the top portion 102 is twisted clockwise about the spray device longitudinal axis 114 relative to the bottle portion 104. As shown, the spray device exterior surface 110 is configured for being gripped by a user at each of the top portion 102 and the bottle portion 104, where a two-handed twist charges the spray device 100 and primes a dose of liquid spray as a dispensable amount of liquid spray for the dispensing step. The liquid spray is formed from a fluid that may be a gas and/or a liquid, and may include particles, filaments, or other non-liquid elements suspended therein without departing from the scope of the present disclosure.

Because the top portion 102 is flush with the bottle portion 104, a user may grip the spray device exterior surface 110 at a location overlapping each of the top portion and the bottom portion, forming an ergonomic gripping surface on the spray device exterior surface 110 between the top portion and the bottle portion. As shown, the top portion 102 is twisted clockwise relative to the bottle portion 104 to prime the spray device 100, however the spray device 100 may be alternatively configured such that the priming step calls for the top portion 102 twisted counterclockwise relative to the bottle portion 104 without departing from the present disclosure. Also, the spray device 100 may be alternatively configured such that the priming step calls for twisting the top portion 102 either clockwise or counterclockwise relative to the bottle portion 104, or a series of clockwise and/or counterclockwise directions relative to the bottle portion 104 without departing from the scope of the present disclosure.

Figure 3:
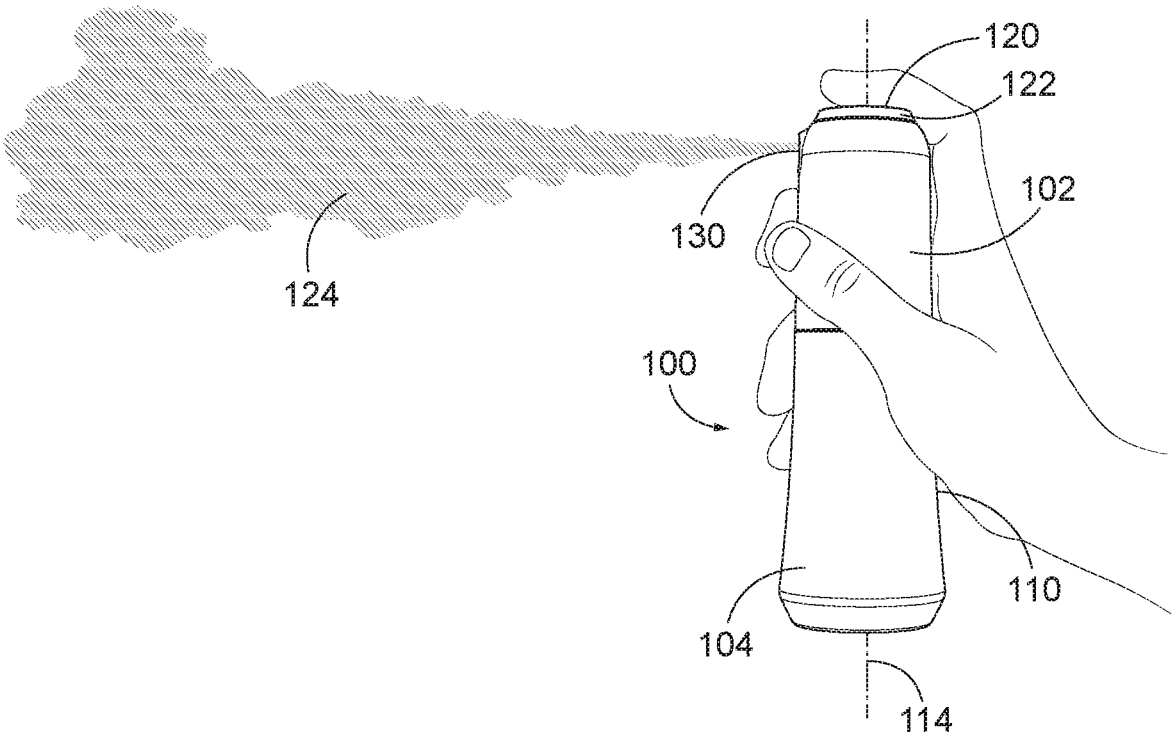
FIG. 3 is a side view of the spray device in a dispensing step.

FIG. 3 depicts the dispensing step, where a top portion top surface 120 defined by a button 122 is pressed to relieve liquid spray 124 from a nozzle 130. The nozzle 130 is inserted into the top portion 102, and is configured to dispense the liquid spray 124 in a direction that is substantially radially outward from the spray device exterior surface 110 and substantially perpendicular to the spray device longitudinal axis 114.

Figure 4:
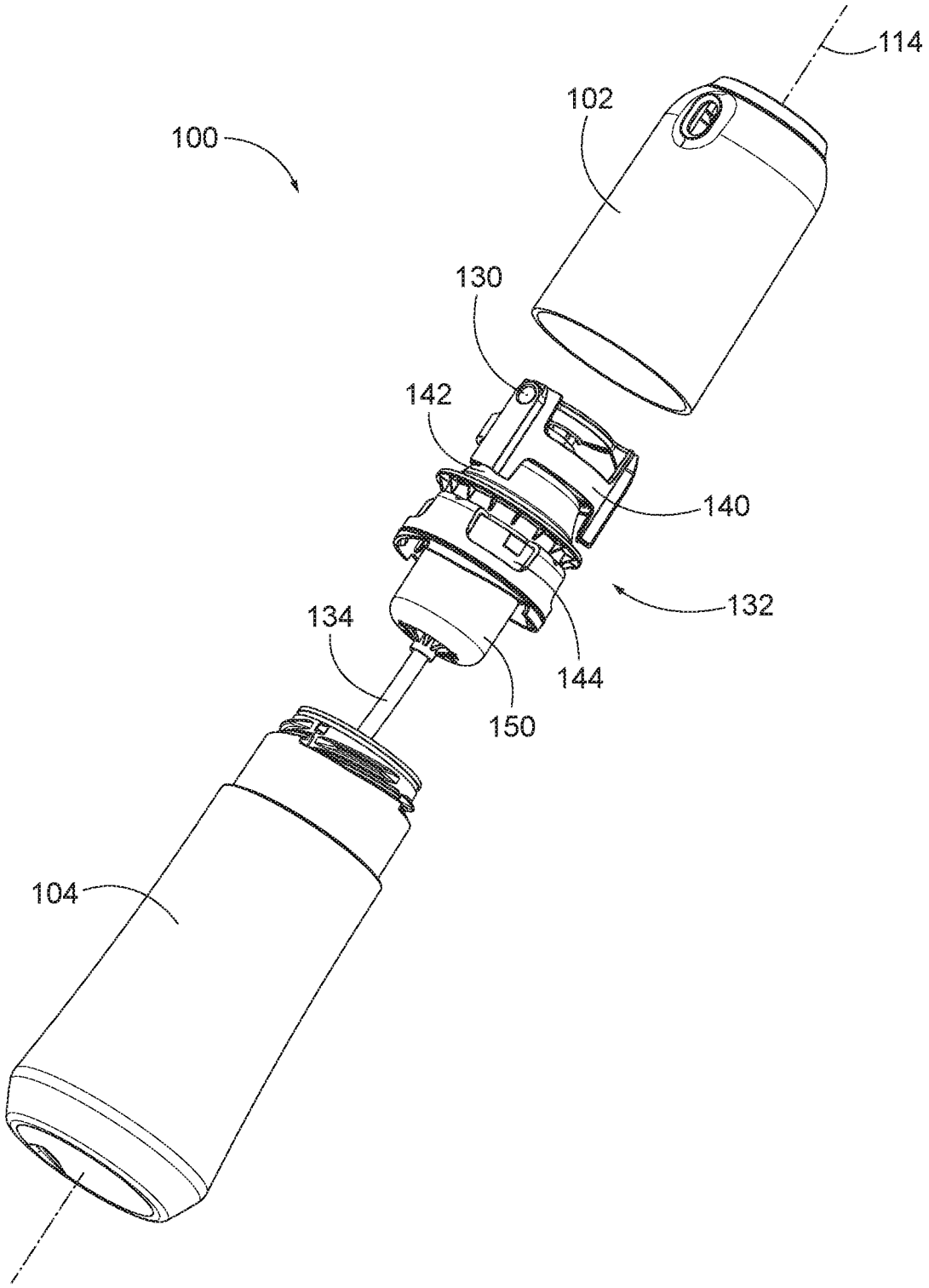
FIG. 4 is an exploded perspective view of the spray device.

FIG. 4 depicts an exploded view of the spray device 100. As depicted, an engine 132 is housed in the spray device 100 between the top portion 102 and the bottle portion 104. The engine 132 is configured for delivering liquid spray to the nozzle 130 from a dip tube 134 which extends into the bottle portion 104 when the spray device 100 is assembled, providing the engine 132 access to liquid spray contained in the bottle portion 104. A spray channel 140 is selectively engageable with the engine 132, which includes, a cap 142, a vent 144, and a cup 150 disposed in line from the top portion 102 to the bottle portion 104 along the spray device longitudinal axis 114.

Figure 5:
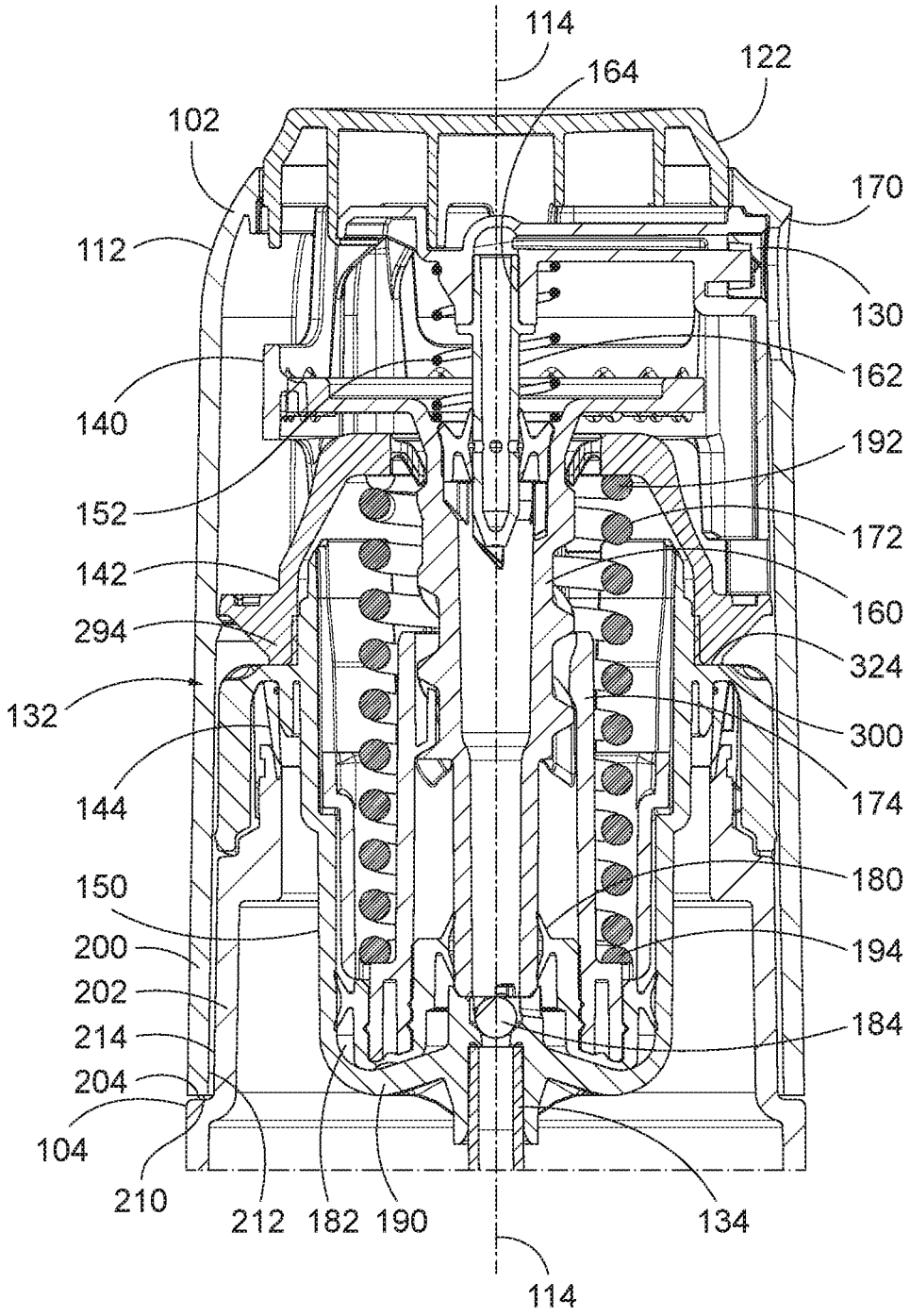
FIG. 5 is a partial cross-sectional view of the spray device.

FIG. 5 depicts a vertical cross-section of the spray device 100 with the engine 132 assembled, and housed in top portion 102 and the bottle portion 104. As depicted, the spray channel 140 is biased upward along the spray device longitudinal axis 114 toward the button 122 with a return spring 152 disposed between the spray channel 140 and a screw 160. A stem 162 is inserted in a stem inlet 164 of the spray channel 140, which is centered on the spray device longitudinal axis 114. The spray channel 140 supports the nozzle 130 in the top portion 102 such that the nozzle 130 is aligned with a spray slot 170 defined in the top portion 102.

The cup 150 is threaded onto the bottle portion 104 such that the cup 150 attaches and retains the cap 142, a main spring 172, a nut 174, and a piston 180 to the bottle portion 104. The cup 150, a piston 180, and the screw 160 in combination form a chamber 182 sealed with a volume that varies as the piston 180 slides along the cup 150 and the screw 160 in a direction parallel with the spray device longitudinal axis 114. The chamber 182 is effectively sealed such that liquid spray does not leak from the chamber 182 and ambient air does not penetrate the chamber 182. The dip tube 134 is housed in the cup 150, in selective fluid communication with the chamber 182. A ball 184 is seated in the cup 150 so as to form a one way valve between the dip tube 134 and the chamber 182 which allows liquid spray to enter the chamber 182 from the dip tube 134, and prevents liquid spray from leaving the chamber 182 to the dip tube 134.

The main spring 172 is disposed between and contained within the cup 150 and the cap 142. The main spring 172 is a compression spring centered on and directed along the spray device longitudinal axis 114, and is configured for biasing the piston 180 toward a cup bottom 190. The main spring 172 includes a spring top end 192 that abuts the cap 142 and a spring bottom end 194 that abuts the nut 174, where the nut 174 is configured to pass a spring force exerted by the main spring 172 onto the cup 150 through to the piston 180. The nut 174 is also threaded with the screw 160, such that rotational movement of the screw 160 about the spray device longitudinal axis 114 results in linear translation of the nut 174 along the spray device longitudinal axis 114.

At an interface between the sleeve 112 and the bottle portion 104, a sleeve bottom end portion 200 extends downward around a bottle portion top end portion 202 to abut a bottle portion lower ledge 204 formed thereon, where a sleeve bottom surface 210 of the sleeve bottom end portion 200 abuts and slidingly engages the bottle portion lower ledge 204. A sleeve inner surface 212 and a bottle portion exterior surface 214 are rounded with respect to the spray device longitudinal axis 114 and are radially spaced from each other with respect to the spray device longitudinal axis 114. In this manner, the top portion 102 and the bottle portion 104 are configured for rotating relative to each other when the bottle portion 104 is engaged with the top portion 102.

Figure 6:
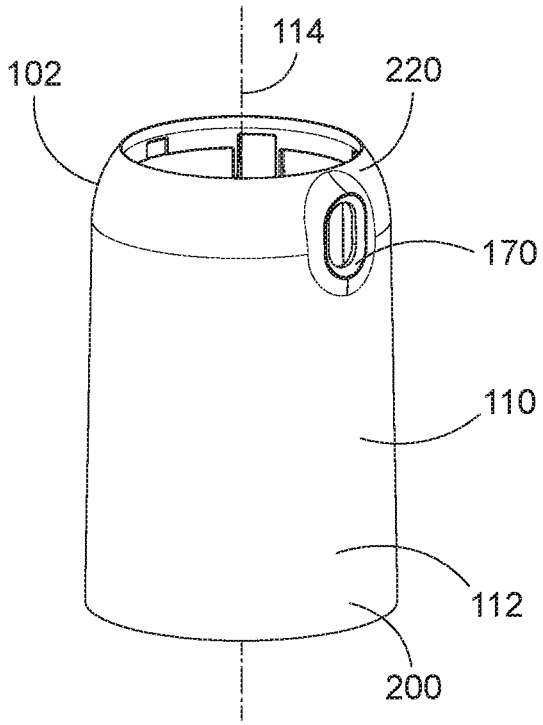
FIG. 6 is a perspective view of a sleeve of the spray device.

FIG. 6 depicts the sleeve 112 including the sleeve bottom end portion 200, a sleeve top end portion 220 configured for receiving the button 122, the spray device exterior surface 110 at the top portion 102, and the spray slot 170. As shown, the spray slot 170 extends integrally from the top portion 102 in a direction radially outward from the spray device longitudinal axis 114 when the top portion 102 is assembled with the spray device 100. The spray slot 170 is configured to form a clearance with a cone of liquid spray dispensed from the nozzle 130.

Figure 7:
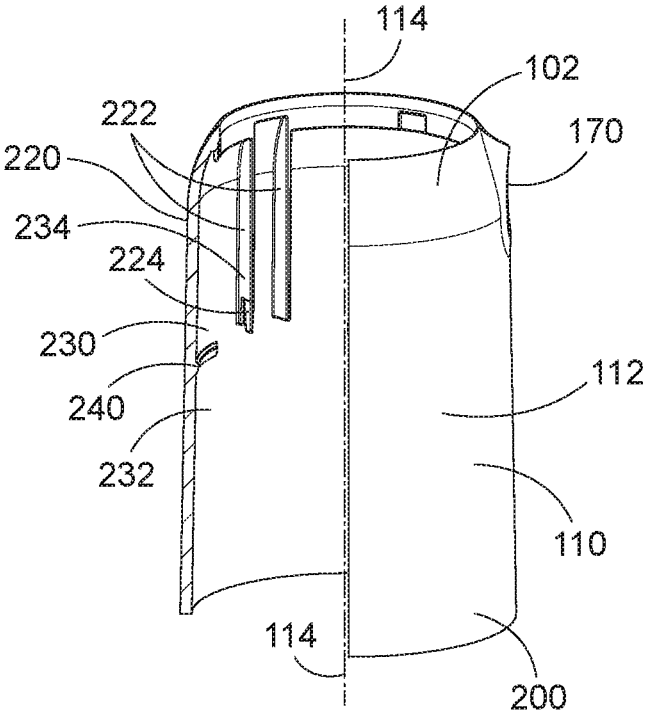
FIG. 7 is a partial perspective view of the sleeve.

FIG. 7 depicts a partial view of the sleeve 112, exposing at least one sleeve rib 222, a clicker blade 224, a sleeve upper bearing 230, and a sleeve lower bearing 232. As shown, the at least one sleeve rib 222 extends along the sleeve top end portion 220, in parallel with the spray device longitudinal axis 114 when the top portion 102 is assembled with the spray device 100. The at least one sleeve rib 222 extends across the sleeve upper bearing 230, toward the sleeve bottom end portion 200. The at least one sleeve rib 222 is configured to constrain the spray channel 140 in a rotational position about the spray device longitudinal axis 114 with respect to the sleeve 112, and transfer torque about the spray device longitudinal axis 114 between the sleeve 112 and the spray channel 140. The clicker blade 224 is disposed on a sleeve rib bottom portion 234 of the at least one sleeve rib 222, extends toward the cap 142, and is configured to produce at least one audible click with complementary features of the cap 142 when the top portion 102 is twisted relative to the bottle portion 104, signaling to a user that a dose of liquid spray is being charged.

The sleeve upper bearing 230 includes an upper bearing detent 240 configured to constrain the cap 142 to a longitudinal position of the sleeve 112 with respect to the spray device longitudinal axis 114. The sleeve lower bearing 232 is configured to surround a circumference of the cap main wall 290 so as to constrain the cap 142 radially about the spray device longitudinal axis 114 with respect to the sleeve 112 when the spray device 100 is assembled.

Figure 8:
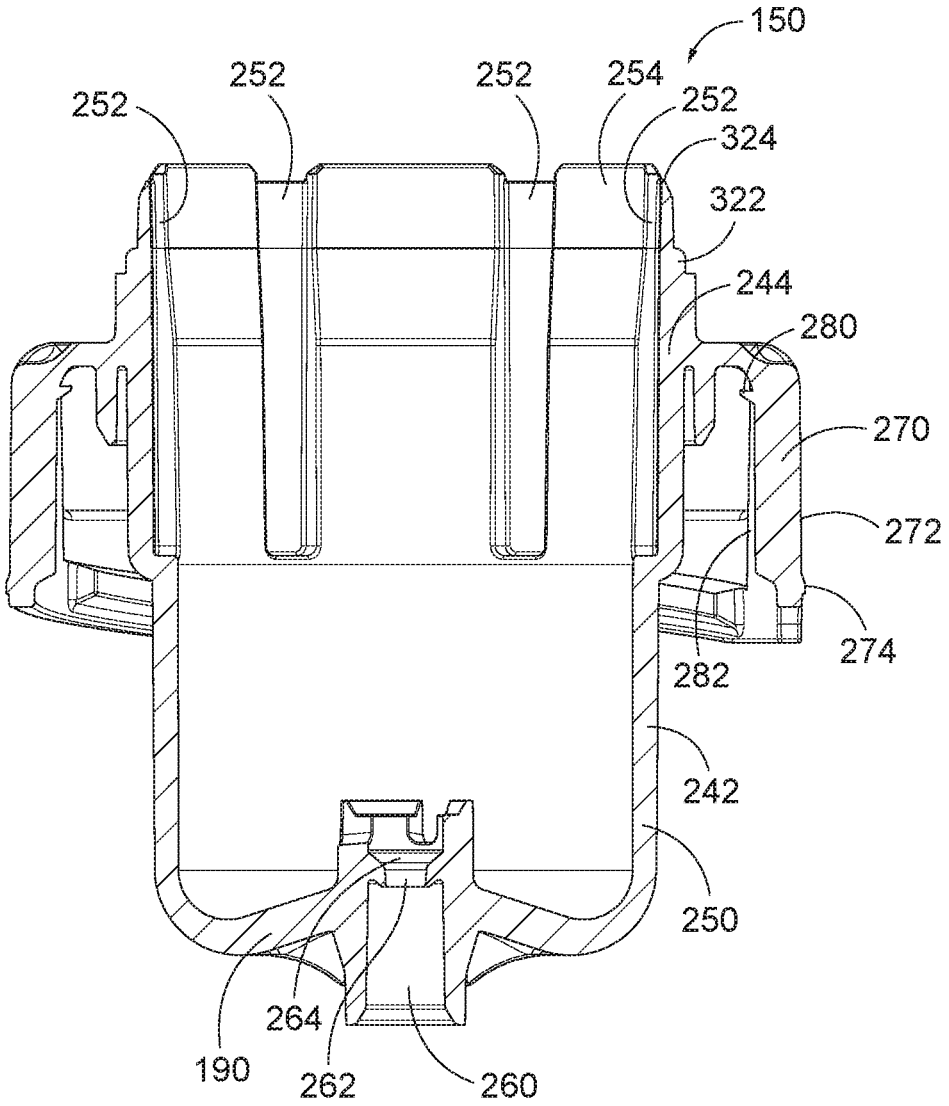
FIG. 8 is a cross-sectional front view of a cup of the spray device.

FIG. 8 depicts a cross-sectional view of the cup 150. As shown, the cup bottom 190 forms a downward axial bearing for the screw 160, and the cup 150 further includes a cup wall 242 formed from a cup wall top portion 244 and a cup wall bottom portion 250. The cup wall top portion 244 is a radial bearing for the screw 160, and at least one cup wall track 252 is defined in a cup wall inner surface 254 at the cup wall top portion 244. The at least one cup wall track 252 is complementary to radially outward facing features of the nut 174 and is configured for catching respective at least one feature of the nut 174 so as to rotationally constrain the nut 174 with respect to the cup 150 about the spray device longitudinal axis 114.

The cup wall inner surface 254 at the cup wall bottom portion 250 forms the chamber 182 with the piston 180. To this end, the cup wall inner surface 254 at the cup wall bottom portion 250 is a seal surface configured for engaging and forming a seal with the piston 180 effective for preventing a leak of liquid spray or penetration of ambient atmosphere into the chamber 182.

A dip tube inlet 260 is centered on the cup bottom 190, and defined in the cup bottom 190 across a cup passage 262 from a cup ball valve seating 264 along the spray device longitudinal axis 114. The dip tube inlet 260 is configured for receiving the dip tube 134, fixing the dip tube 134 with the cup 150, and bringing the dip tube 134 in fluid communication with the cup ball valve seating 264. The cup ball valve seating 264 is configured for receiving the ball 184 so as to form the one way valve.

At least one cup rib 270 integrally extends radially outward from the cup wall top portion 244, the at least one cup rib 270 being configured for engaging the bottle portion 104 so as to fix the cup 150 with the bottle portion 104. A cup rib outer face 272 of the at least one cup rib 270 includes at least one sleeve bearing 274 configured to abut the sleeve inner surface 212 when the cup 150 is assembled with the sleeve 112. When the sleeve 112, the bottle portion 104, and the cup 150 are assembled, the at least one sleeve bearing 274, the sleeve 112, and the bottle portion 104 occupy a same longitudinal position of the spray device 100 such that a radial force applied to the spray device 100 at the longitudinal position passes through each of the at least one sleeve bearing 274, sleeve 112, and the bottle portion 104. The at least one cup rib 270 further includes at least one vent retention clip 280 extending radially inward from a cup rib inner surface 282 at a longitudinal position located toward the cup wall top portion 244.

In the illustrated embodiment, when the spray device 100 is assembled, the cup 150 is hidden from view from outside the spray device 100 by at least the sleeve 112. However, in an alternative embodiment, an outer flange of the cup 150 is exposed to view from outside the spray device 100, for example, through a combination of extending the at least one cup rib 270 and shortening the sleeve 112. This alternative embodiment allows the exposed outer flange to serve as a non-rotating surface that can be gripped by equipment to screw the top portion 102 onto the bottle without charging the engine 132, when the spray device 100 is assembled.

Figure 9:
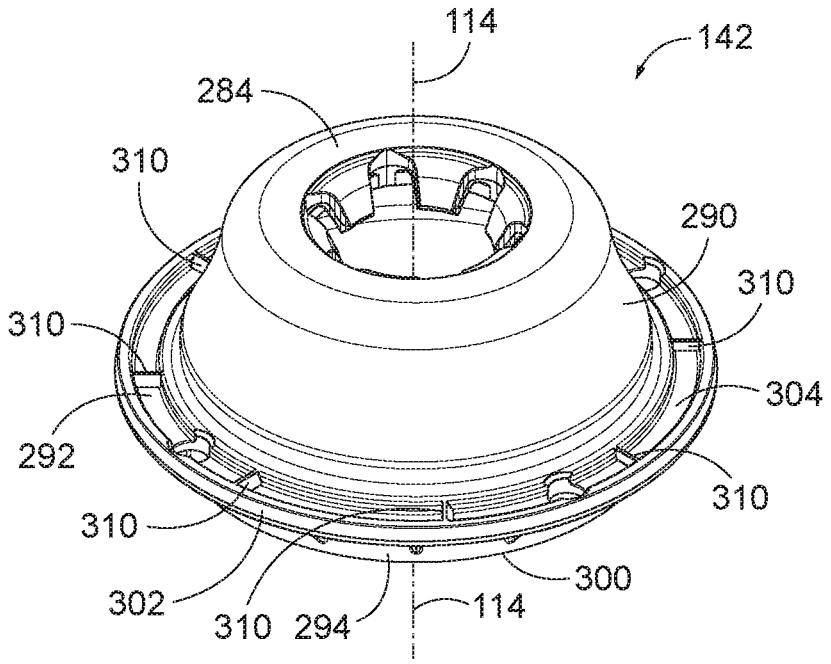
FIG. 9 is a perspective view of a cap of the spray device.

As shown in FIG. 9, the cap 142 includes a cap top face 284, a cap main wall 290, a cap flange 292 extended from the cap main wall 290, a cap weld wall 294, and a cap bottom face 300. The cap main wall 290 integrally extends downward and radially outward from the cap top face 284 to the cap flange 292, and the cap weld wall 294 extends integrally downward from the cap main wall 290 so as to receive spin welding geometry of the cup 150 at the cup wall top portion 244. In an embodiment, the cap 142 and the cup 150 are formed from the same material and are spin welded together so as to form a single unitary piece featuring integrally formed components. In further embodiments, the material choice of the cap 142 and the cup 150 exclude slip, mold release, or antistatic additives, since these materials can adversely affect the quality of the spin-welds. In embodiments, at least one of the cap 142 and the cup 150 are formed from polypropylene (PP), and in further embodiments at least one of the cap 142 and the cup 150 are formed from polyethylene (PET). Notably, alternative materials having similar properties to PP and/or PET may be employed in the cap 142 and/or the cup 150 without departing from the scope of the present disclosure. In an alternative embodiment of the spray device 100, the cap 142 and the cup 150 are joined using clips (not shown). In further alternative embodiments of the spray device 100, the cap 142 and the cup 150 are joined using clips instead of being joined by spin welding.

The cap flange 292 extends radially outward from the cap main wall 290, with a radial circumference defined by a cap flange outer face 302. A clicker channel 304 is defined in the cap flange 292 between the cap main wall 290 and the cap flange outer face 302 in a radial direction perpendicular to the spray device longitudinal axis 114. The clicker channel 304 includes at least one clicker rib 310 disposed therein. The clicker blade 224 is disposed in the clicker channel 304 when the top portion 102 is assembled with the cap 142, the at least one clicker rib 310 being configured for engaging the clicker blade 224 when the top portion 102 is twisted relative to the bottle portion 104, and by extension the sleeve 112 is twisted relative to the cap 142. When the at least one clicker rib 310 engages the clicker blade 224, a click sound audible to a user handling the spray device 100 is produced, the click sound corresponding with a dose of liquid spray being charged to a given extent. The upper bearing detent 240 of the sleeve 112 projects radially inward from the sleeve inner surface 212 and the cap flange 292 is configured to catch the upper bearing detent 240, including at the cap flange outer face 302.

Figure 10:
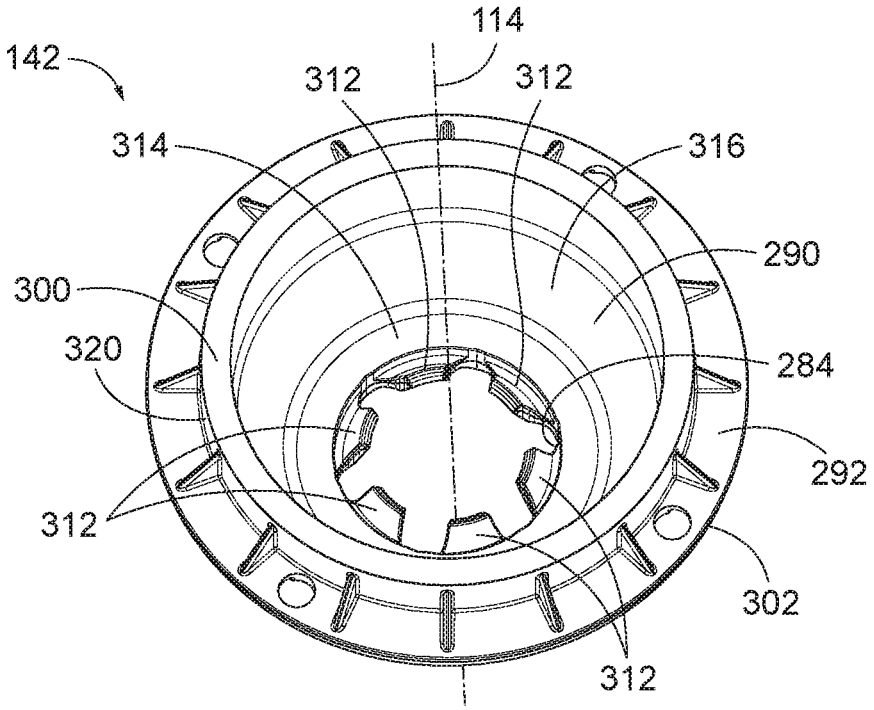
FIG. 10 is a perspective view of the cap of the spray device.

As shown in FIG. 10, at least one screw retention clip 312 extends integrally downward and radially inward from the cap top face 284, the at least one screw retention clip 312 being configured for engaging the screw 160 and retaining the screw 160 to the cap 142. In the depicted in embodiment, the at least one screw retention clip 312 is six screw retention clips, however more or fewer similar screw retaining clips may be employed in the spray device 100 without departing from the scope of the present disclosure.

A cap main spring contact face 314 is defined on a cap interior surface 316 configured to face the cup 150 when the cap 142 and the cup 150 are assembled, the cap main spring contact face 314 being configured to abut and retain the main spring 172. Each of the cap main spring contact face 314 and the spring top end 192 can be flattened to increase a contact surface area between the cap 142 and the main spring 172 at the cap main spring contact face 314 and the spring top end 192.

The cap bottom face 300 is located at a cap weld wall bottom end 320, is shaped substantially flat toward the cup 150, and is oriented substantially perpendicular to the spray device longitudinal axis 114 when the spray device 100 is assembled. In this manner, the cap weld wall 294 including the cap bottom face 300 is configured for engaging the weld geometry of the cup 150. As depicted in FIG. 8, weld geometry of the cup includes a cup shoulder 322 with a cup top face 324 defining a top most surface of the cup 150. As depicted in FIG. 5, the cup top face 324 and the cap bottom face 300 are shaped substantially flat toward each other, and are oriented substantially perpendicular to the spray device longitudinal axis 114 when the spray device 100 is assembled. Also, the cap weld wall 294 surrounds and contacts the cup shoulder 322 so as to form a weld surface between the cap 142 and the cup 150.

Figure 11:
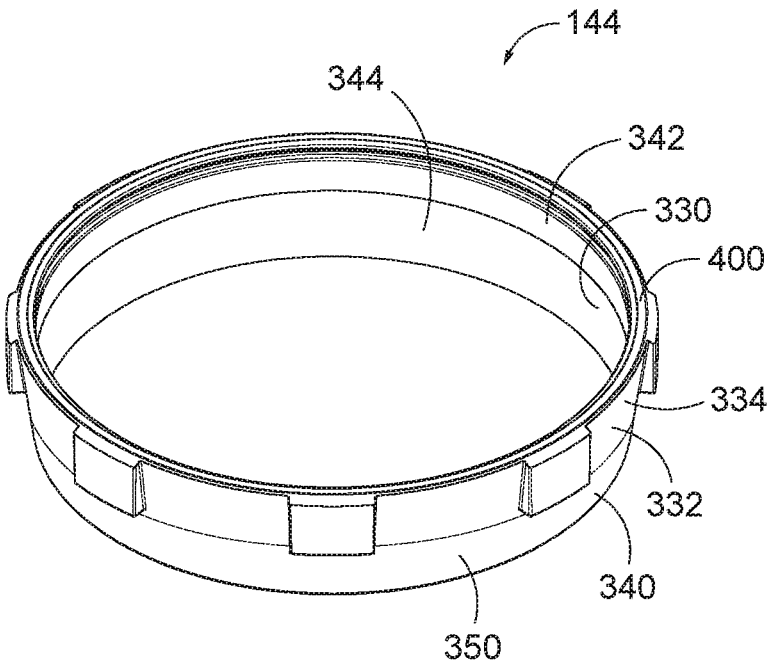
FIG. 11 is a perspective view of a vent of the spray device.

When the spray device 100 is assembled, the vent 144 is configured to provide a seal between the bottle portion 104 and the cup 150 to prevent liquid spray leakage, and allow ambient air to vent into the bottle portion 104 to replace dispensed liquid spray. As shown in FIG. 11, the vent 144 is substantially ring shaped and includes a vent inner face 330, a vent outer face 332, a vent top end portion 334, and a vent bottom end portion 340. The vent inner face 330 includes a vent cup retention face 342 at the vent top end portion 334, the vent cup retention face 342 being configured to retain the cup 150 in the vent 144 and form a seal with the cup 150 when the spray device 100 is assembled. The vent inner face 330 includes a vent lower inner face 344 at the vent bottom end portion 340, and when the vent 144 is sealed with the cup 150 and the bottle portion 104, the vent lower inner face 344 continues a sealed surface between the cup 150 and the bottle portion 104.

The vent outer face 332 includes a vent bottle sealing face 350 at the vent bottom end portion 340, which is configured to create a seal with the bottle portion 104 when the cup 150, bottle portion 104, and the vent 144 are assembled. When the cup 150, bottle portion 104, and the vent 144 are assembled, the cup 150 is engaged with the vent cup retention face 342 and the bottle portion 104 is engaged with the sealing face such that the vent outer face 332 continues a sealed surface between the cup 150 and the bottle portion 104.

Figure 12:
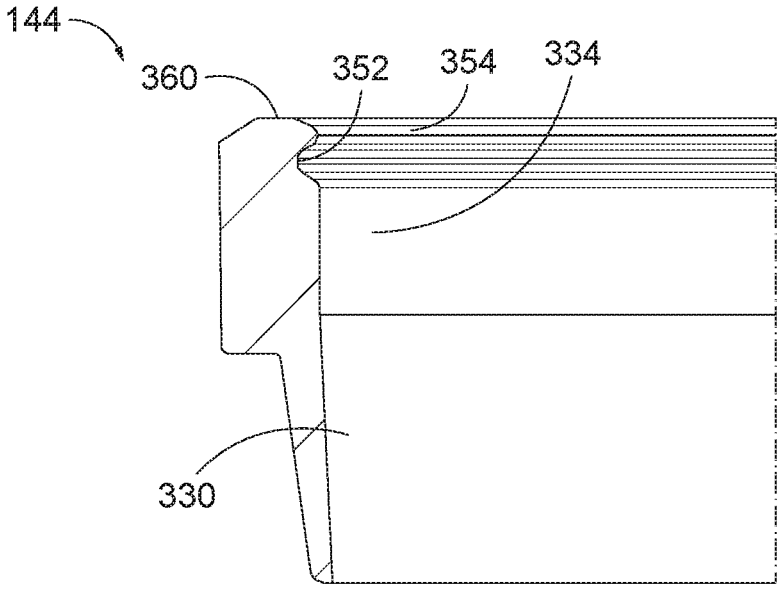
FIG. 12 is a partial cross-sectional view of the vent of the spray device.

FIG. 12 depicts a partial cross section of the vent 144. As shown, a vent groove 352 is defined in the vent 144, on the vent inner face 330 at the vent top end portion 334. A vent detent 354 is formed on the vent inner face 330 between the vent groove 352 and a vent top face 360, the vent detent 354 being configured to retain the vent 144 to the cup 150. In an embodiment, the vent 144 is formed from low density polyethylene (LDPE). In another embodiment, the vent 144 is formed from thermoplastic polyurethane (TPU). Notably, alternative materials similar to LDPE and TPU may be employed in the vent 144 without departing from the scope of the present disclosure.

Figure 13:
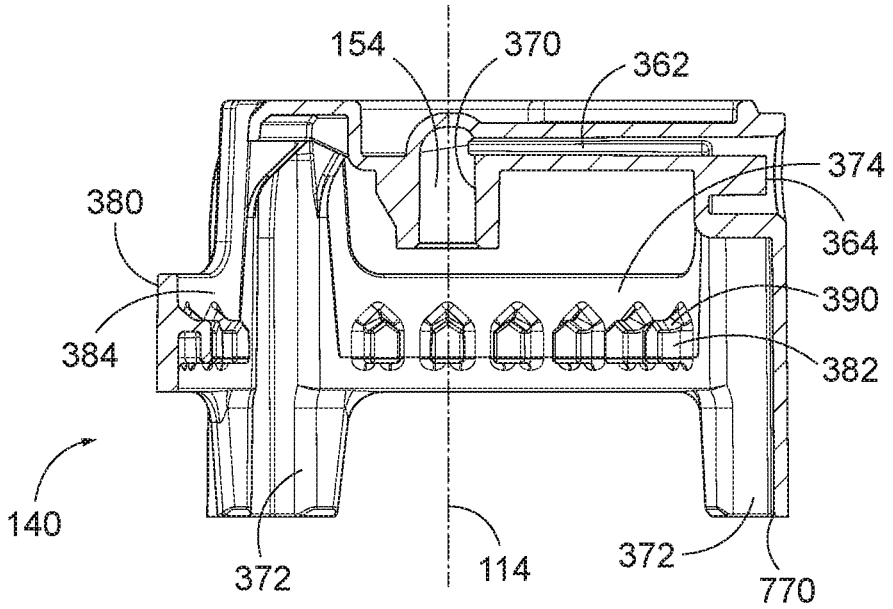
FIG. 13 is a cross-sectional side view of a spray channel of the spray device.

The spray channel 140 houses the nozzle 130 and provides a flow path for liquid spray between the stem 162 and the nozzle 130. As shown in FIG. 13, a flow path is formed from the stem inlet 154 and a spray channel passage 362 defined in the spray channel 140, the spray channel passage 362 extending between the stem inlet 154 and a nozzle boss 364 configured for supporting the nozzle 130 on the spray channel 140. The stem inlet 154 is defined in the spray channel 140 with a radial location centered on the spray device longitudinal axis 114 and an orientation parallel with the spray device longitudinal axis 114 when the spray device 100 is assembled. With this construction, the radial position of the stem 162 in the stem inlet 154 does not vary about the spray device longitudinal axis 114 when the top portion 102 and by extension the spray channel 140 is twisted relative to the bottle portion 104. A stem inlet interior surface 370 forms an interface with the stem 162, where the stem inlet interior surface 370 forms a seal with the stem 162 effective for maintaining an internal operating pressure between the stem 162 and the spray channel 140 without leaking any liquid spray. The nozzle boss 364 is substantially cylindrical, and in this manner is configured for supporting the nozzle 130 without requiring a specific rotational position of the nozzle 130 with respect to nozzle boss 364 and the spray channel 140.

Figure 14:
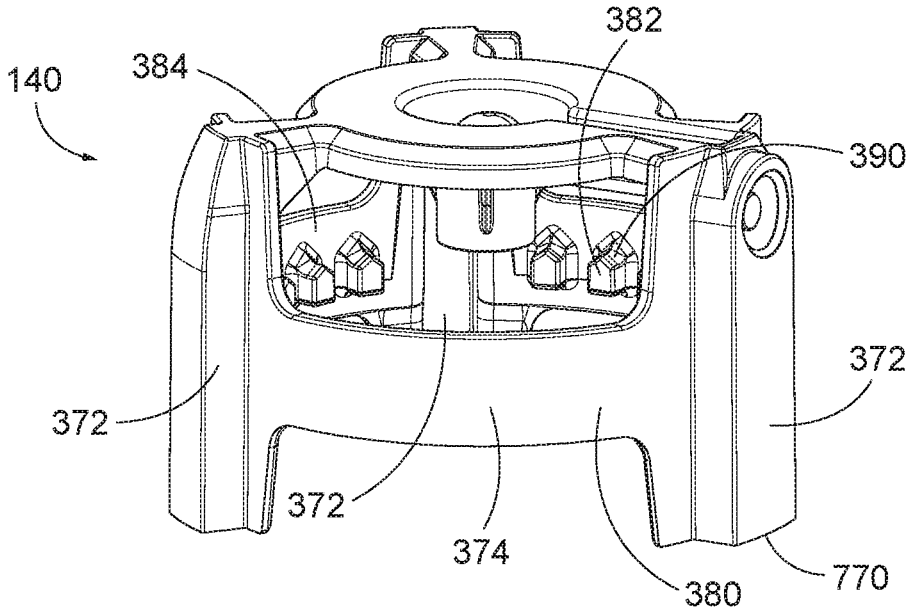
FIG. 14 is a perspective view of the channel of the spray device.

The spray channel 140 provides a clutch configured for selective engagement with the screw 160 so as to convert rotational movement of the sleeve to rotational movement of the screw and axial movement of the nut. As shown in FIGS. 13 and 14, the spray channel 140 includes at least one spray channel leg 372 located radially outward of a spray channel ring segment 374, the at least one spray channel leg 372 extending downward toward the cap flange 292 when the spray device 100 is assembled. Each of the at least one spray channel leg 372 is configured for engagement with the at least one sleeve rib 222 extended radially inward from the sleeve 112. The at least one spray channel leg 372 respectively abuts the at least one sleeve rib 222 in a rotational direction of the sleeve 112 relative to the bottle portion 104 about the spray device longitudinal axis 114 so as to transfer rotational forces between the at least one spray channel leg 372 and the at least one sleeve rib 222.

The spray channel ring segment 374 is supported on the at least one spray channel leg 372 at a spray channel ring segment exterior surface 380 and features at least one spray channel clutch tooth 382 extending radially inward from the spray channel ring segment 374 on a spray channel ring segment interior surface 384. Each of the at least one spray channel one clutch tooth 382 includes a lead-in segment 390 that is inclined from the spray channel ring segment 374 toward the spray device longitudinal axis 114, downward along the spray device longitudinal axis 114. In the depicted embodiment, the at least one spray channel clutch tooth 382 is six spray channel clutch teeth disposed between consecutive spray channel legs of the at least one spray channel leg 372 about the spray channel ring segment 374, however more or fewer spray channel clutch teeth may be employed with varying distribution patterns along the spray channel ring segment 374 without departing from the scope of the present disclosure. The at least one spray channel clutch tooth 382 is configured to directly engage the screw 160 and transmit torque between the screw 160 and the spray channel 140.

The at least one spray channel clutch tooth 382 includes a clutch tooth clip 392 extending toward the return spring 152. The clutch tooth clip 392 is configured to retain the return spring 152 on the at least one spray channel clutch tooth 382. In an embodiment, the spray channel 140 is formed from high density polyethylene (HDPE). In another embodiment, the spray channel 140 is formed from polypropylene (PP). In another embodiment, the spray channel 140 is formed from polyoxymethylene (POM). Notably, the spray channel 140 may be formed from materials similar to HDPE, PP, and/or POM without departing from the scope of the present disclosure. Also, in the depicted embodiment of the spray channel 140 the at least one spray channel leg 372 is three spray channel legs, however more or fewer spray channel legs may be employed in the spray channel 140 without departing from the scope of the present disclosure.

Figure 15:
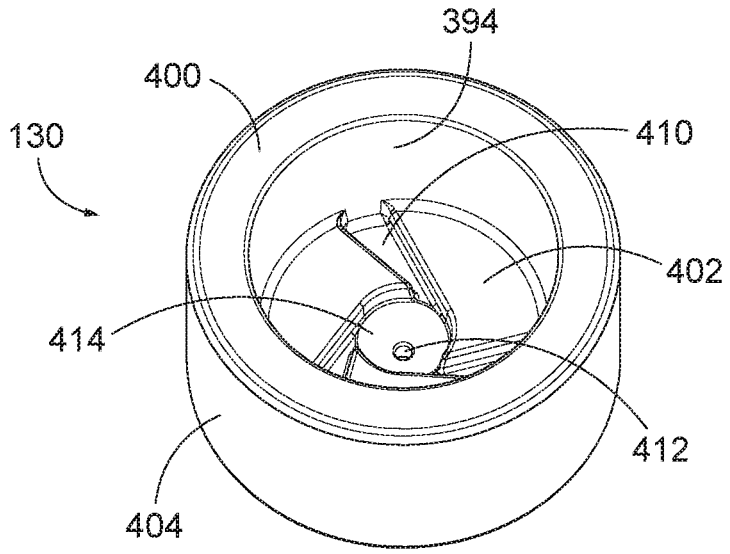
FIG. 15 is a perspective view of a nozzle of the spray device.

The nozzle 130 is configured to produce an atomized spray, given a supply of pressurized liquid spray introduced from the spray channel passage 362. With reference to FIG. 15, the nozzle 130 includes a nozzle main wall 394 which extends between a nozzle back face 400 and a nozzle mounting face 402. An outer periphery of the nozzle main wall 394 defines a nozzle outer face 404. The nozzle outer face 404 is a retention face configured for retaining the nozzle 130 in the spray channel 140 as an interface between the nozzle 130 and the spray channel 140 at the nozzle boss 364.

The nozzle mounting face 402 includes at least one swirl vane 410 defined therein, with each of the at least one swirl vane 410 being directed from a periphery of the nozzle mounting face 402 at the nozzle main wall 394 toward a center of the nozzle mounting face 402 which features a nozzle orifice 412 defined therein. The at least one swirl vane 410 is defined with a decreasing width from the periphery of the nozzle mounting face 402 to the center of the nozzle mounting face 402. Each of the at least one swirl vane 410 has a direction leading off center of the nozzle orifice 412 and into a swirl chamber 414 defined in the nozzle mounting face 402, so as to facilitate a swirl in fluid flow of the liquid spray when the liquid spray is dispensed from the spray device 100. Notably, other nozzle 130 and spray channel 140 designs which produce different spray patterns with regard to particle size, velocity, cone angle and other aspects of a spray pattern, and nozzle 130 and spray channel 140 designs that produce foams or jets of fluid that do not break into a spray may be employed without departing from the scope of the present disclosure.

Figure 16:
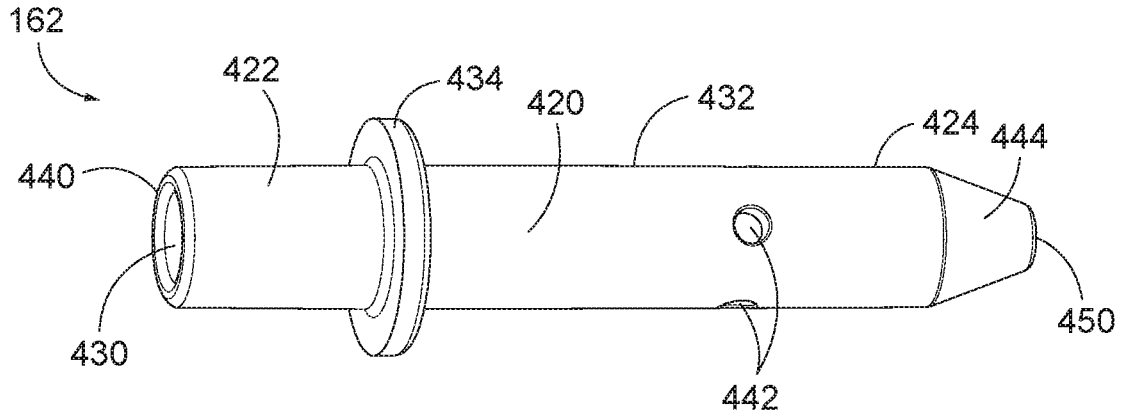
FIG. 16 is a perspective view of a stem of the spray device.

The stem 162 is configured to selectively allow fluid flow therethrough, from the screw 160 to the spray channel 140. As shown in FIG. 16, the stem 162 includes a stem wall 420 including a stem top end portion 422, a stem bottom end portion 424, a stem interior surface 430, and a stem exterior surface 432. The stem 162 includes a stem flange 434 extending radially outward from the stem exterior surface 432 at the stem top end portion 422. The stem flange 434 has a longitudinal position offset from a stem top end face 440, forming retention geometry of the stem 162 configured for retaining the stem 162 in the stem inlet 154.

At least one stem orifice 442 is defined in the stem 162 and is configured for passing liquid spray through the stem wall 420 from the stem exterior surface 432 to the stem interior surface 430, at the stem bottom end portion 424. In the depicted embodiment, the at least one stem orifice 442 is four stem orifices evenly spaced circumferentially about the stem 162 at a same longitudinal position along the stem 162. The stem exterior surface 432 at the stem bottom end portion 424 defines a sealing face that extends above a top most part of the at least one stem orifice 442, and extends below a bottom most part of the at least one stem orifice 442, along the spray device longitudinal axis 114. Notably, the at least one stem orifice 442 may include more or fewer similar orifices that may or may not be evenly disposed about a circumference of the stem 162, and that may or may not share a same longitudinal position along the stem 162, without departing from the scope of the present disclosure.

The stem 162 includes a stem lead-in segment 444 that is radially inclined downward about the spray device longitudinal axis 114. The incline of the stem lead-in segment 444 converges to a stem bottom face 450. In an embodiment, the stem 162 is formed through injection molding and the stem bottom face 450 is an injection location used in forming the stem 162. In an embodiment, the stem 162 is formed from polyoxymethylene (POM). Notably, alternative materials and methods of forming the stem 162 may be employed without departing from the scope of the present disclosure.

Figure 17:
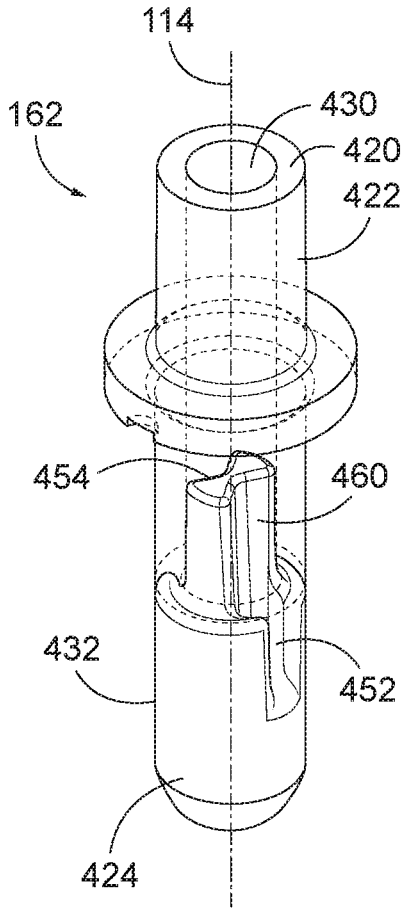
FIG. 17 is a perspective view of a stem of the spray device according to an alternative embodiment.

In an alternative stem 162 embodiment depicted in FIG. 17 that does not feature the at least one stem orifice 442, the stem 162 includes a stem first channel 452 and a stem second channel 454 defined in the stem 162 by an obstruction 460 disposed in the stem 162, within the stem interior surface 430. The stem first channel 452 and the stem second channel 454 are defined through the stem exterior surface 432, configured to allow fluid flow into the stem 162, and individually extend through the stem bottom end portion 424 to the stem top end portion 422. The stem first channel 452 and the stem second channel 454 are defined through the stem wall 420 on radially opposite sides of the stem 162 with respect to the spray device longitudinal axis 114, such that the stem first channel 452 and the stem second channel 454 are evenly disposed about a circumference of the stem 162. The obstruction 460 extends axially midway into the stem 162, such that the stem first channel 452 and the stem second channel 454 end midway in the stem 162. With this construction, fluid flow in the stem first channel 452 and the stem second channel 454 combines into a single flow path at the end of the obstruction 460, before reaching the spray channel 140, reducing a pressure drop across the stem 162 when the liquid spray is dispensed.

Figure 18:
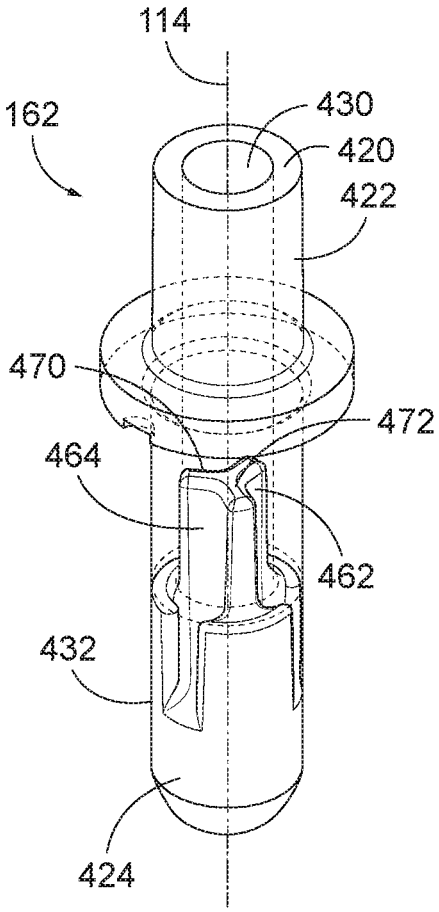
FIG. 18 is a perspective view of a stem of the spray device according to an alternative embodiment.

In an alternative stem 162 embodiment depicted in FIG. 18, the stem 162 includes a stem first channel 462, a stem second channel 464, and a stem third channel 470 defined in the stem 162 by an obstruction 472 and the stem interior surface 430. The stem first channel 462, the stem second channel 464, and the stem third channel 470 are configured to allow fluid flow into the stem 162 and individually extend through the stem bottom end portion 424 along the length of the obstruction 472. The stem first channel 462, the stem second channel 464, and the stem third channel 470 are defined through the stem exterior surface 432 such that the stem first channel 462, the stem second channel 464, and the stem third channel 470 are evenly disposed about a circumference of the stem 162. The obstruction 472 extends midway into the stem 162 such that the stem first channel 462, the stem second channel 464, and the stem third channel 470 end midway in the stem 162. With this construction, fluid flow in the stem first channel 462, the stem second channel 464, and the stem third channel 470 combines into a single flow path before reaching the spray channel 140, reducing a pressure drop in the stem 162 when the liquid spray is dispensed.

Figure 19:
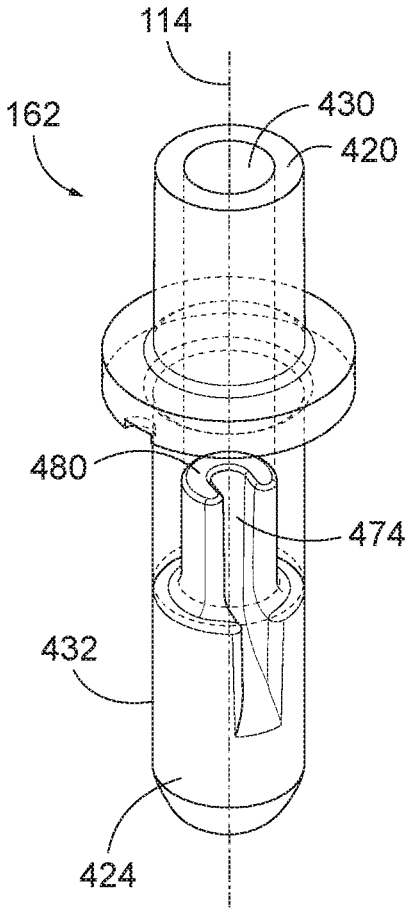
FIG. 19 is a perspective view of a stem of the spray device according to an alternative embodiment.

In an alternative stem 162 embodiment depicted in FIG. 19, the stem 162 includes a U-shaped channel 474 defined between the stem interior surface 430 and an obstruction 480. The U-shaped channel 474 is configured to allow fluid flow into the stem 162 and extends through the stem bottom end portion 424. The obstruction 480 extends midway into the stem 162, restricting a cross-sectional area defined by the stem interior surface 430 and a fluid flow rate through the stem 162 at the obstruction 480. The obstruction 480 defining the U-shaped channel 474 ends midway in the stem 162 along the spray device longitudinal axis 114 such that fluid flow in the stem 162 is unrestricted by the obstruction 480 before reaching the spray channel 140, reducing a pressure drop across the stem 162 when the liquid spray is dispensed.

Figure 20:
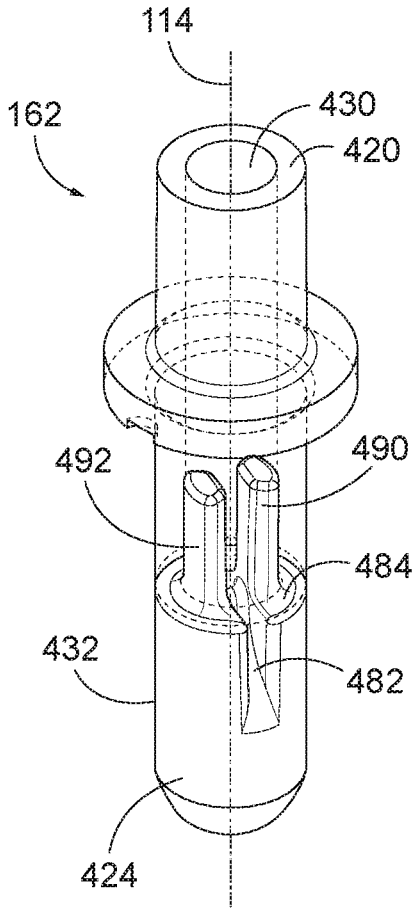
FIG. 20 is a perspective view of a stem of the spray device according to an alternative embodiment.

In an alternative stem 162 embodiment depicted in FIG. 20, a stem opening 482 is defined through the stem wall 420 and an obstruction 484 disposed in the stem 162 includes a first protrusion 490 and a second protrusion 492 which extend through the stem bottom end portion 424 from the stem opening 482 to a longitudinal position of the stem 162 midway through the stem 162. The first protrusion 490 and the second protrusion 492 reduce a cross-sectional area inside the stem 162, reducing a pressure drop across the stem 162 when liquid spray is dispensed.

Figure 21:
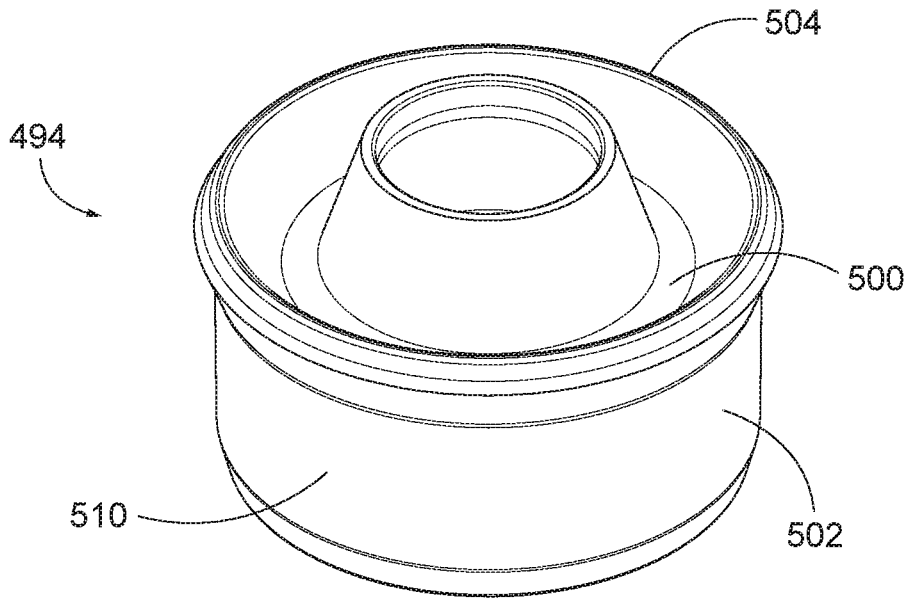
FIG. 21 is a perspective view of a valve of the spray device.

A valve 494 is configured to create a seal between the stem 162 and the screw 160, preventing air ingress and/or leakage of liquid spray between the stem 162 and the screw 160. As shown in FIG. 21, the valve 494 includes a valve ring segment 500, a valve outer wall 502 extending downward from the valve ring segment 500, and a valve detent 504 extending upward and radially outward from the valve ring segment 500. The valve 494 is housed in the screw 160, and the valve detent 504 is configured to abut a complementary projection extending from the screw 160 so as to retain the valve 494 in the screw 160. A valve outer wall exterior surface 510 defines an interface between the valve 494 and the screw 160, and forms a sealing surface between the valve 494 and the screw 160 effective to prohibit liquid spray or ambient air from passing between the valve 494 and the screw 160.

Figure 22:
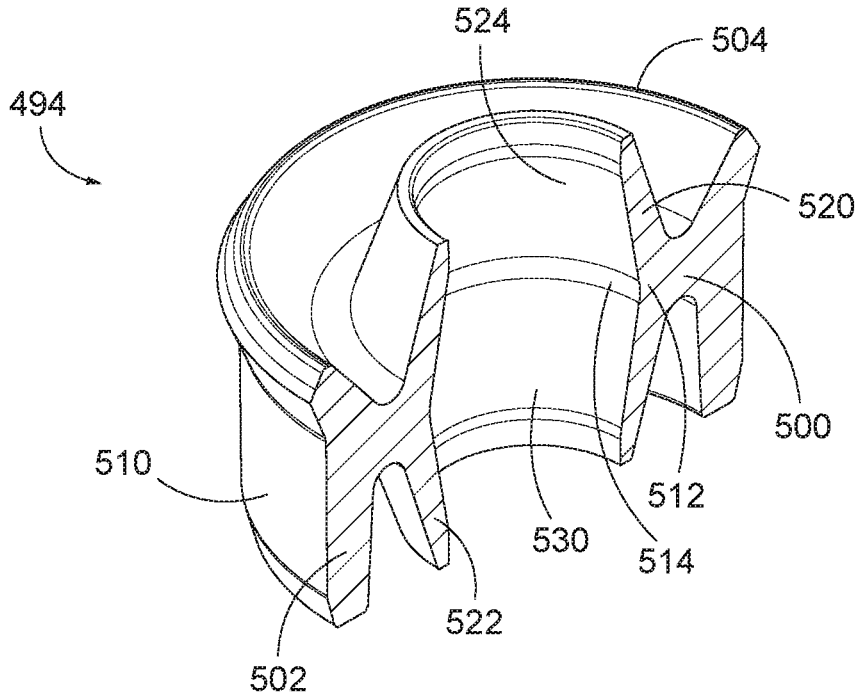
FIG. 22 is a perspective cross-sectional view of the spray device.

In FIG. 22, a valve inner wall 512 extends from the valve ring segment 500, and a valve inner wall interior surface 514 defines an interface between the valve 494 and the stem 162, and forms a sealing surface between the valve 494 and the stem 162 effective to prohibit liquid spray or ambient air from passing between the valve 494 and the stem 162. The valve inner wall 512 is formed from an upper sealing blade 520 which extends upward from the valve ring segment 500 and a lower sealing blade 522 which extends downward from the valve ring segment 500. An upper sealing blade interior surface 524 extends the valve inner wall interior surface 514 upwards relative to the valve ring segment 500 and a lower sealing blade interior surface 530 extends the valve inner wall interior surface 514 downward relative to the valve ring segment 500. The upper sealing blade 520 and the lower sealing blade 522 extend sufficiently far from the valve ring segment 500 so as to cover the stem bottom end portion 424 at each of the at least one stem orifice 442. In an embodiment, the valve 494 is formed from low density polyethylene (LDPE), however similar materials may be employed in forming the valve 494 without departing from the scope of the present disclosure.

Figure 23:
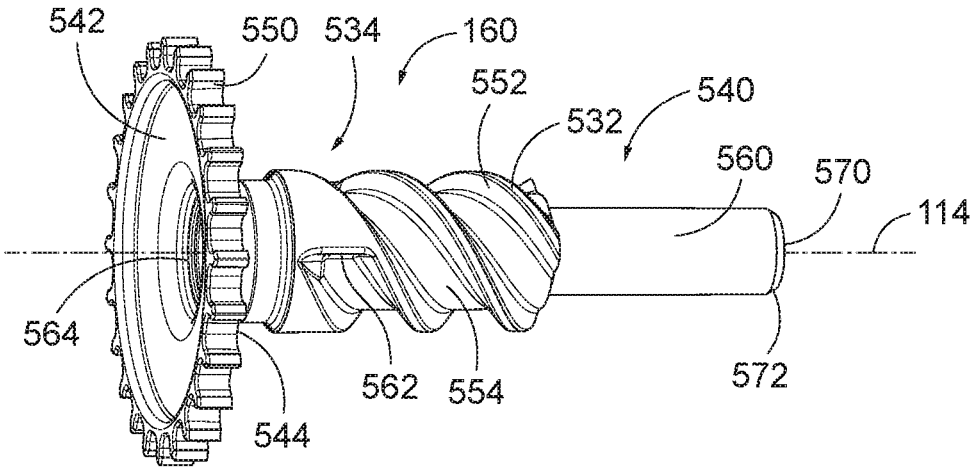
FIG. 23 is a perspective view of a screw of the spray device.

The screw 160 brings the stem 162 and the chamber 182 in fluid communication, and is configured to function as a clutch which converts rotational movement of the sleeve 112 and spray channel 140 into linear axial movement of the nut 174 along the spray device longitudinal axis 114. As shown in FIG. 23, the screw 160 is formed from a screw main wall 532 forming a screw top end portion 534 and a screw bottom end portion 540. A screw flange 542 extends radially outward from the screw top end portion 534 at a screw top end 544, and is configured for engagement with the spray channel 140. Specifically, the screw flange 542 includes at least one screw clutch tooth 550 corresponding with the at least one spray channel clutch tooth 382, where the at least one screw clutch tooth 550 is configured to respectively interlink and rotationally fix with the at least one spray channel clutch tooth 382.

Screw threading 552 disposed on a screw main wall outer surface 554 extends between the screw flange 542 and a screw sealing face 560 configured for engaging the piston 180, along the spray device longitudinal axis 114. The screw threading 552 provides an interface with the nut 174, such that when the screw 160 is rotated with the spray channel 140, the nut 174 is driven linearly along the spray device longitudinal axis 114, with complementary features of the nut 174 sliding along the at least one cup wall track 252. The screw threading 552 further includes a screw threading stop 562, which is a face ending the screw threading 552 and functions as a rotational end stop against the nut 174 corresponding with an end of charging a dose of liquid spray.

The screw sealing face 560 allows the piston 180 to slide against the screw 160 and maintain the seal of the chamber 182. The length of the screw sealing face 560 along the spray device longitudinal axis 114 is sufficient to enable the nut 174 and the piston 180 to travel a distance along the spray device longitudinal axis 114 corresponding with dispensing at least one dose of liquid spray. The screw main wall 532 defines a screw channel 564 extended through a screw hole 570 at a screw bottom end 572 at the screw bottom end portion 540.

Figure 24:
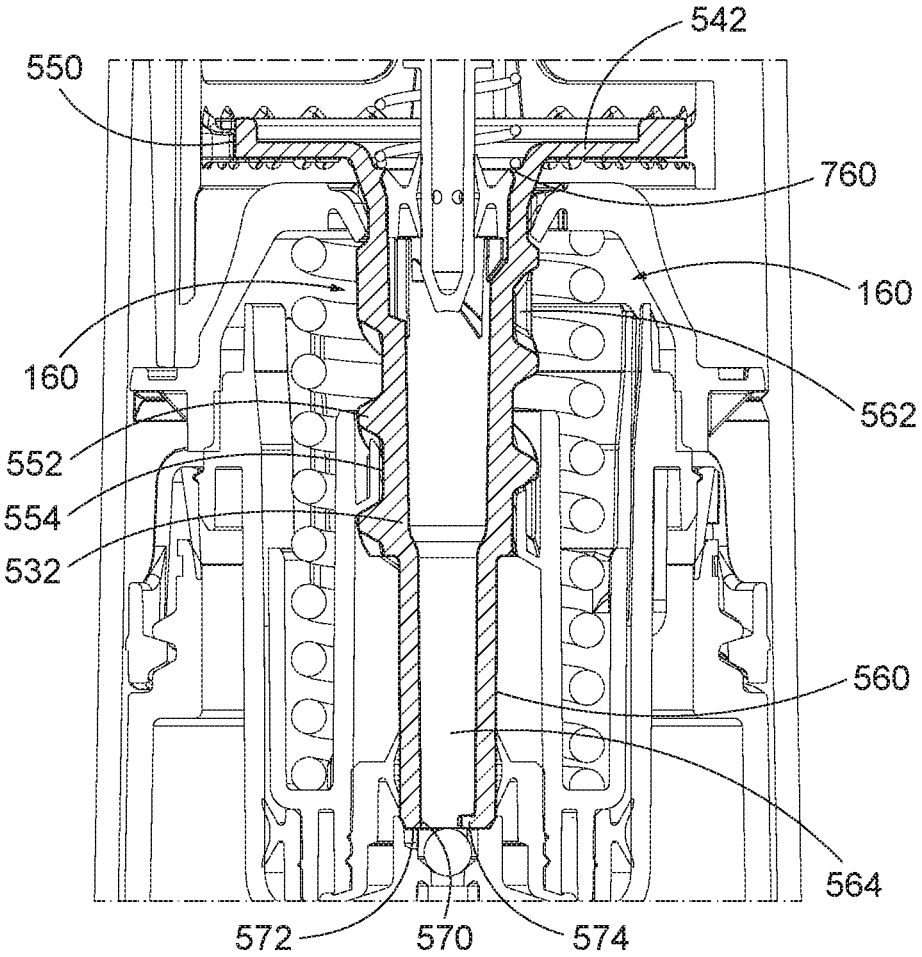
FIG. 24 is a cross-sectional front view of the screw of the spray device.

As depicted in FIG. 24, a screw bottom end lip 574 extends radially inward from screw main wall 532 at the screw bottom end 572, into the screw hole 570. The screw bottom end lip 574 is configured to obstruct passage of the ball 184 into the screw channel 564, while enabling passage of the liquid spray into the screw channel 564.

In an embodiment, the screw 160 is formed from polyoxymethylene (POM). In another embodiment the screw 160 is formed from polyethylene (PET). Notably, the screw 160 may be formed of materials similar to POM and/or PET without departing from the scope of the present disclosure.

Figure 25:
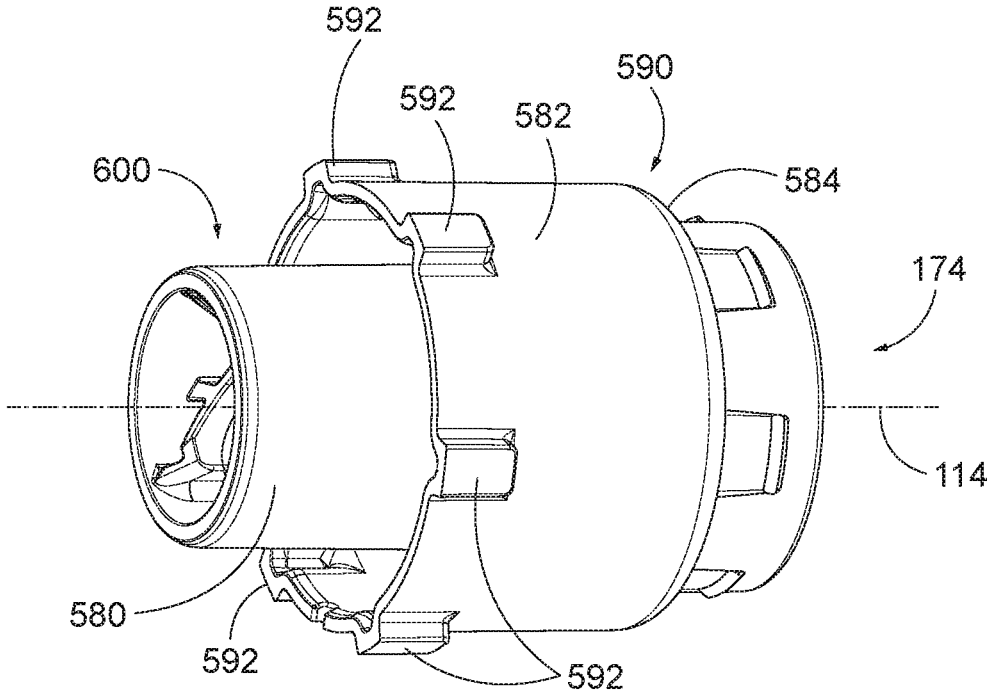
FIG. 25 is a perspective view of a nut of the spray device.
Figure 26:
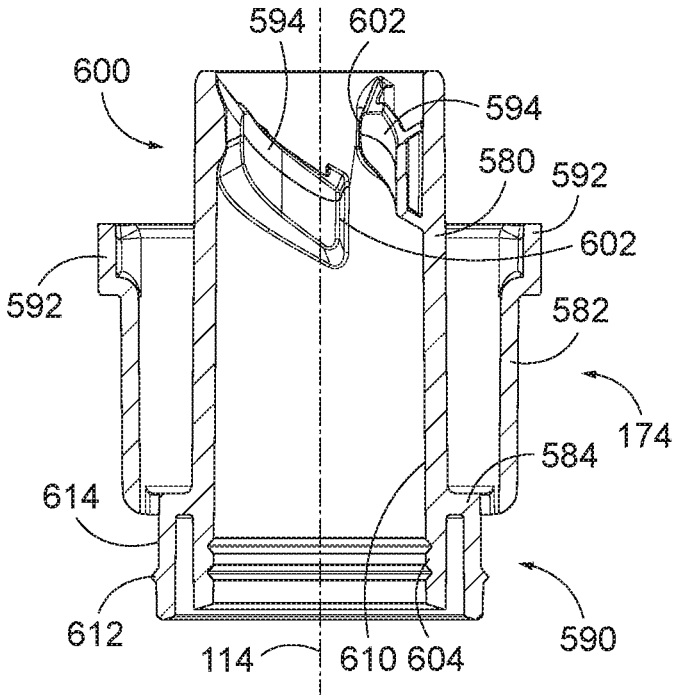
FIG. 26 is a cross-sectional front view of the nut of the spray device.

The nut 174 is configured to convert rotational movement of the screw 160 around the spray device longitudinal axis 114 into linear axial movement of the nut 174, the main spring 172, and the piston 180 along the spray device longitudinal axis 114. As depicted in FIGS. 25 and 26, the nut 174 is formed from a nut inner wall 580 and a nut outer wall 582 joined to the nut inner wall 580 through a nut floor 584 at a nut bottom end portion 590. The nut floor 584 is configured to retain the main spring 172 in the longitudinal direction, while the nut inner wall 580 and the nut outer wall 582 restrict radial movement of the main spring 172 with respect to the spray device longitudinal axis 114. In this manner, the nut 174 is configured to house the main spring 172, and be driven by the main spring 172 across the cup 150 along the spray device longitudinal axis 114 when the top portion 102 is rotated relative to the bottle portion 104.

The nut outer wall 582 includes at least one nut outer wall ridge 592 corresponding with and complementary to the at least one cup wall track 252. When the at least one nut outer wall ridge 592 is respectively engaged with the at least one cup wall track 252, the nut 174 is rotationally fixed with the cup 150 and is able to slide along the spray device longitudinal axis 114 relative to the cup 150.

The nut inner wall 580 includes nut threading 594 defined therein at a nut top end portion 600. The nut threading 594 engages with and is complementary to the screw threading 552, such that when the screw threading 552 is rotated and slides along the nut threading 594, the nut threading 594 drives the nut 174 linearly along the spray device longitudinal axis 114. The nut threading 594 includes at least one nut threading end face 602 defining an end of the nut threading 594 that is a rotational end stop between the screw 160 and the nut 174.

The nut inner wall 580 includes at least one nut inner wall detent 604 defined in a nut inner wall inner surface 610 and configured for engaging complementary features of the piston 180. The nut outer wall 582 includes at least one nut outer wall detent 612 disposed on a nut outer wall outer surface 614 and configured for engaging complementary features of the piston 180. When the at least one nut inner wall detent 604 and the at least one nut outer wall detent 612 are respectively engaged with the piston 180, the nut 174 is fixed with the piston 180 at the nut bottom end portion 590.

In an embodiment, the nut 174 is formed from polycarbonate (PC). In an alternative embodiment, the nut 174 is formed from Polyoxymethylene (POM). In an alternative embodiment, the nut 174 is formed from polyamide (PA). In an alternative embodiment, the nut 174 is formed from polyethylene (PET). Notably, the nut 174 may be formed from materials similar to PC, POM, PA, and/or PET without departing from the scope of the present disclosure.

Figure 27:
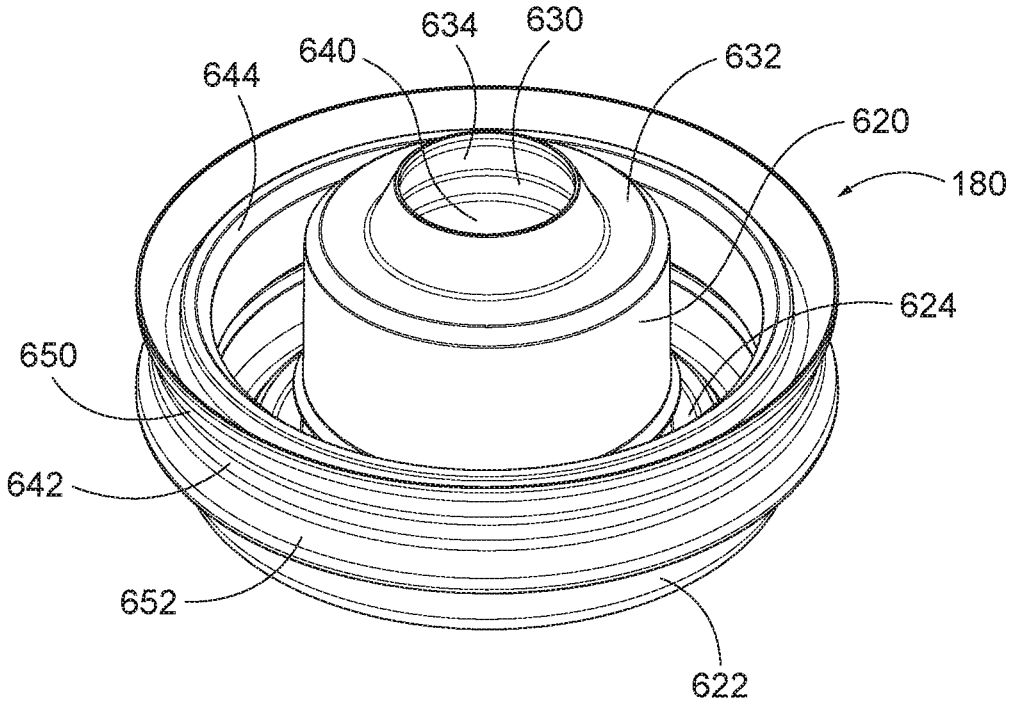
FIG. 27 is a perspective view of a piston of the spray device.

The piston 180, the cup 150, and the screw 160 together form the chamber 182, which is sealed sufficiently to prevent liquid spray from leaking from the chamber 182, and to prevent ambient air from penetrating the chamber 182. When the spray device 100 is assembled, the piston 180 is fixed to the nut bottom end portion 590, and is configured for engaging the cup 150 as an end stop of the nut 174. As shown in FIG. 27, the piston 180 includes a piston inner wall 620 and a piston outer wall 622 connected to the piston outer wall 622 across a piston web 624. A piston inner flat 630 disposed on a piston inner wall top end portion 632 is a sealing surface formed from a piston inner upper sealing blade 634 and a piston inner lower sealing blade 640 respectively extending upwards and downwards from the piston inner wall top end portion 632, the piston inner flat 630 being configured for engaging and sealing against the screw sealing face 560. A piston outer flat 642 disposed on a piston outer wall top end portion 644 is a sealing surface formed from a piston outer upper sealing blade 650 and a piston outer lower sealing blade 652 respectively extending upward and downward from the piston outer wall top end portion 644, the piston outer flat 642 being configured for engaging the cup wall inner surface 254 at the cup wall bottom portion 250.

Figure 28:
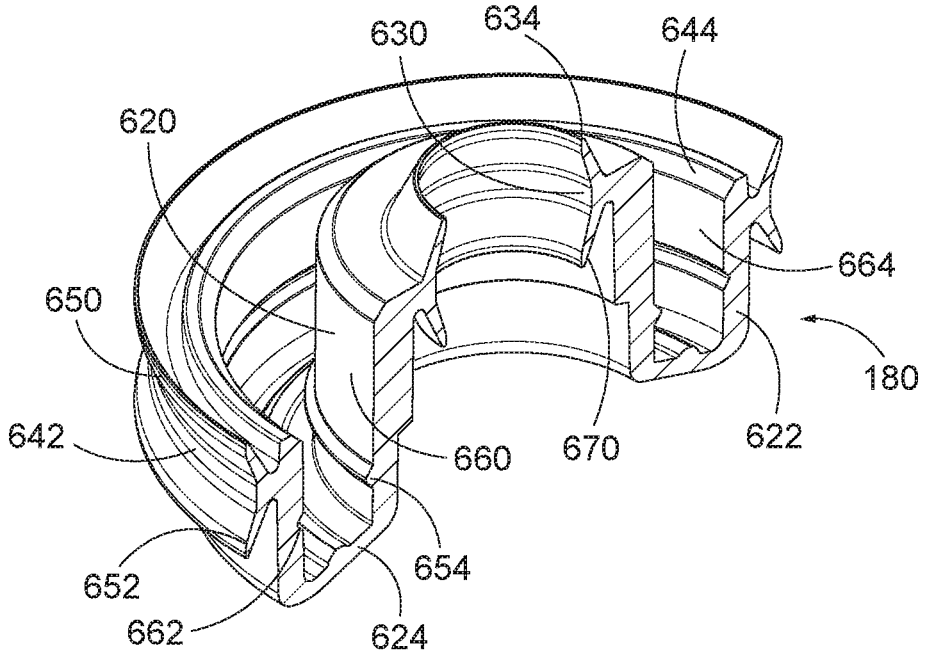
FIG. 28 is a cross-sectional perspective view of the piston of the spray device.

With reference to FIG. 28, the piston inner wall 620 includes a piston inner wall detent 654 formed on a piston inner wall outer surface 660, the piston inner wall detent 654 being configured for engaging the nut 174 and fixing the piston 180 with the nut 174. The piston outer wall 622 includes a piston outer wall detent 662 formed on a piston outer wall inner surface 664, the piston outer wall detent 662 being configured for engaging the nut 174 and fixing the piston 180 with the nut 174. In an embodiment, the piston 180 is formed from low density polyethylene (LDPE), however a material similar to LDPE may be employed in forming the piston 180 without departing from the scope of the present disclosure.

Figure 29:
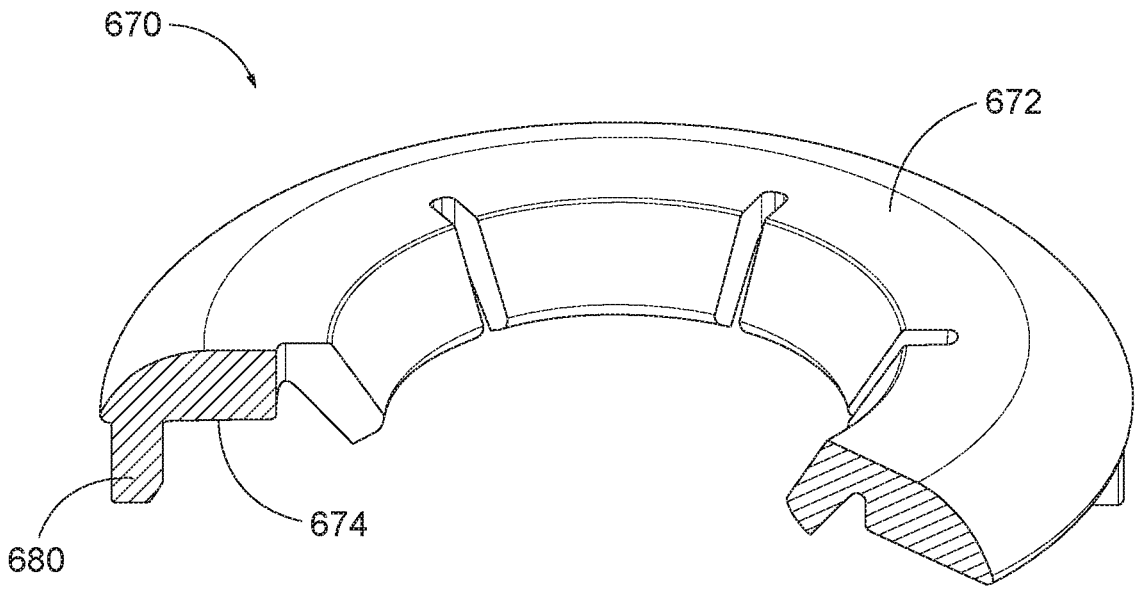
FIG. 29 is a cross-sectional perspective view of a washer of the spray device.

An embodiment of the spray device 100 includes a washer 670 disposed in the cap 142 configured for retaining the spring top end 192. As shown in FIG. 29, the washer 670 includes a washer top face 672 having a curvature that fits within and conforms to the cap bottom face 300, where the washer 670 is configured for being seated. The washer 670 includes a washer bottom face 674 configured for retaining the main spring 172 in an axial direction along the spray device longitudinal axis 114. At least one washer rib 680 extends downward from the washer bottom face 674 and is configured for retaining a radial position of the main spring 172 relative to the cap 142 with respect to the spray device longitudinal axis 114. In an embodiment, the washer 670 is formed from polypropylene (PP), however a similar material may be employed in forming the washer 670 without departing from the scope of the present disclosure.

Figure 30:
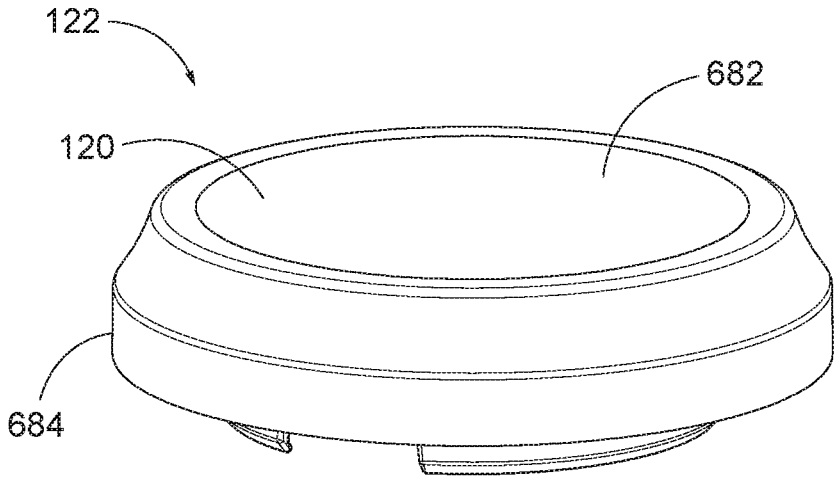
FIG. 30 is a perspective view of a button of the spray device.
Figure 31:
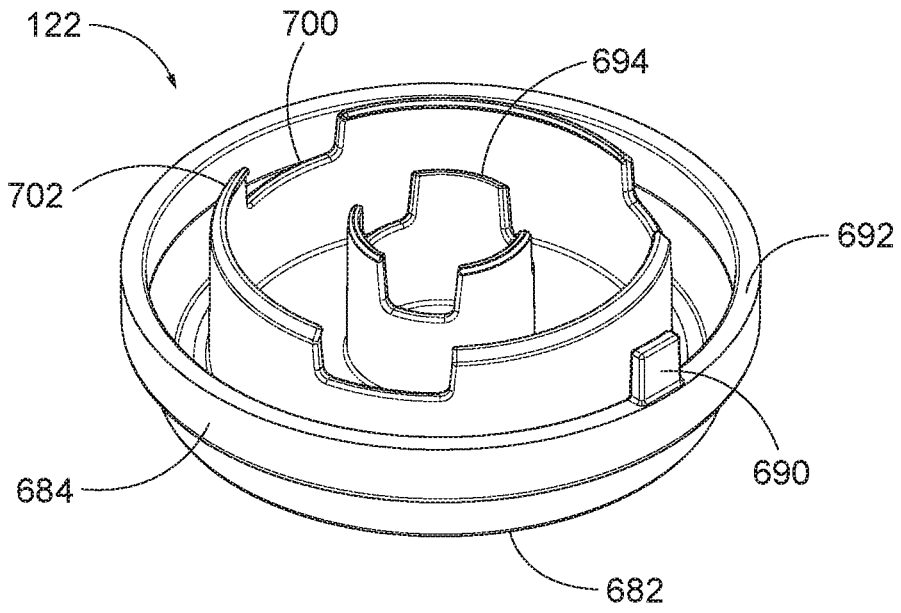
FIG. 31 is a perspective view of the button of the spray device.

The button 122 is configured for being depressed into the spray device 100 by a user, in turn depressing the spray channel 140 relative to the screw 160. As shown in FIGS. 30 and 31, the button 122 includes a button press face 682 that is the top portion top surface 120, and is configured for being depressed by a user. A button outer ring 684 defines an outer periphery of the button 122 configured to fit within the sleeve top end portion 220. The button outer ring 684 includes a button outer ring tab 690 extending downward from a button outer ring bottom surface 692.

The button 122 includes a button inner ring 694 and a button middle ring 700 disposed between the button outer ring 684 and the button inner ring 694 in a radial direction of the button 122 with respect to the spray device longitudinal axis 114. Each of the button inner ring 694 and the button middle ring 700 are configured to engage the spray channel 140, and transfer axial motion between the button 122 and the spray channel 140 in a direction parallel with the spray device longitudinal axis 114.

Figure 32:
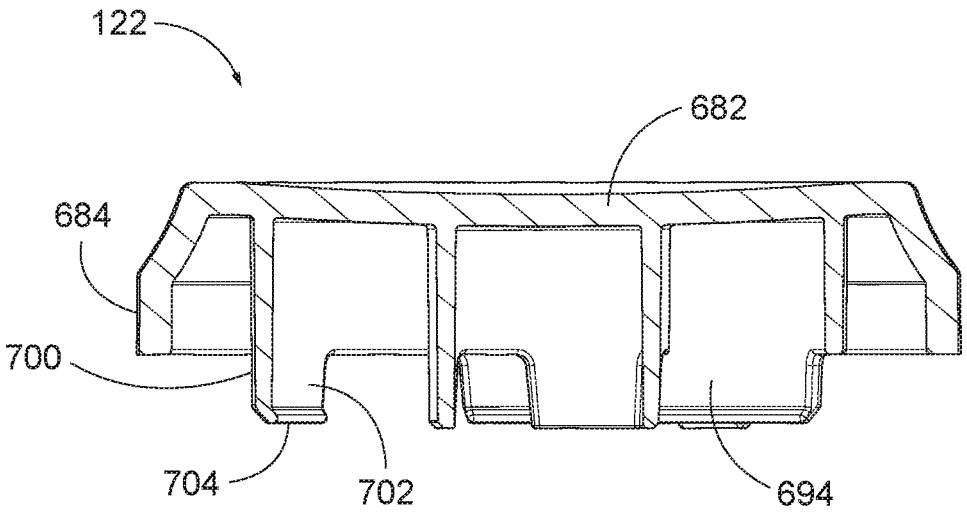
FIG. 32 is a cross-sectional side view of the button of the spray device.

The button middle ring 700 includes at least one button clip 702 configured to fix the button 122 with the spray channel 140. As shown in FIG. 32, the at least one button clip 702 is tapered at a button clip bottom end 704. In the depicted embodiment, the at least one button clip 702 is three clips, however more or fewer clips may be employed without departing from the scope of the present disclosure. In an embodiment, the button is formed from polypropylene (PP), however a similar material may be employed in forming the button 122 without departing from the scope of the present disclosure.

Figure 33:
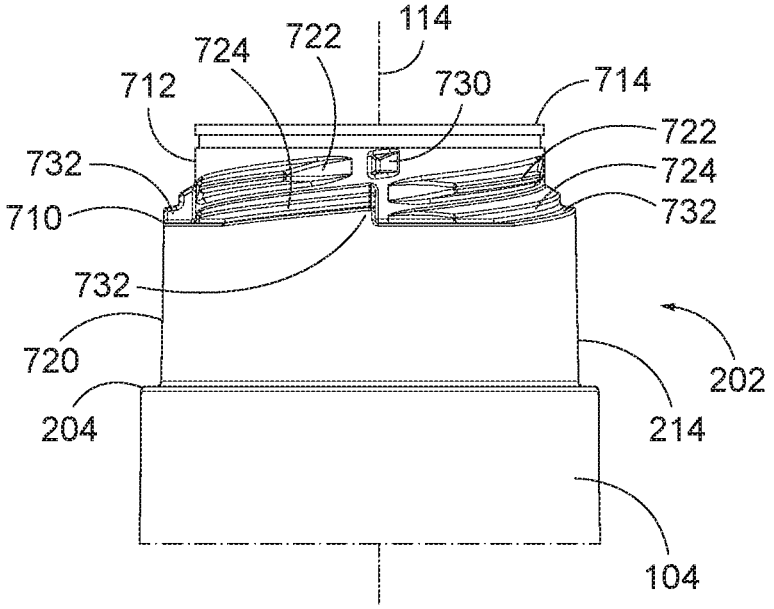
FIG. 33 is a partial front view of a bottle portion of the spray device.

The bottle portion 104 is configured to store a reservoir of liquid spray, and attach to the cup 150 such that the bottle portion 104 and the cup 150 may be rotated together relative to the sleeve 112 in charging a dose of liquid spray. In FIG. 33, the bottle portion top end portion 202 includes a bottle portion upper ledge 710, the bottle portion lower ledge 204, a bottle portion upper neck 712 between the bottle portion upper ledge 710 and a bottle portion upper end 714 along the spray device longitudinal axis 114, and a bottle portion lower neck 720 between the bottle portion upper ledge 710 and the bottle portion lower ledge 204 along the spray device longitudinal axis 114.

The bottle portion upper neck 712 includes a threaded section with at least one upper thread 722, at least one lower thread 724, and at least one bottle portion detent 730 extended from the bottle portion exterior surface 214, the threaded section being configured for engaging complementary features of the cup 150 so as to fix the cup 150 with the bottle portion 104. The bottle portion 104 also includes at least one bottle portion stop 732 respectively provided after a rotational end point of the at least one upper thread 722 and the at least one lower thread 724. The at least one bottle portion stop 732 is a rotational end stop for the cup 150 during attachment of the cup 150 to the bottle portion 104, and in charging a dose of liquid spray. With this construction, the cup 150 is screwed onto the bottle portion 104 until the bottle portion 104 abuts the bottle portion upper ledge 710 and the at least one bottle portion stop 732, where the at least one bottle portion detent 730 rotationally retains the cup 150 with the bottle portion 104, fixing the cup 150 with the bottle portion 104.

The bottle portion lower ledge 204 is configured to support the sleeve 112 on the bottle portion 104, and allow the sleeve 112 to rotate about the spray device longitudinal axis 114 relative to the bottle portion 104. To this end, the bottle portion exterior surface 214 at the bottle portion lower neck 720 is smooth and rounded about the spray device longitudinal axis 114, and the sleeve inner surface 212 at the bottle portion lower neck 720 is smooth and rounded about the spray device longitudinal axis 114 so as to fit around the bottle portion lower neck 720.

The bottle portion 104 contains a reservoir of liquid spray and is chemically resistant to the liquid spray. As an exterior component of the spray device 100, the bottle portion 104 is also impact resistant. In an embodiment, the bottle portion 104 is formed from polyethylene (PET). In another embodiment, the bottle portion is formed from polypropylene (PP). Notably, the bottle portion 104 may be designed to a variety of specific tolerances and/or formed from a variety of similar materials without departing from the scope of the present disclosure.

Figure 34:
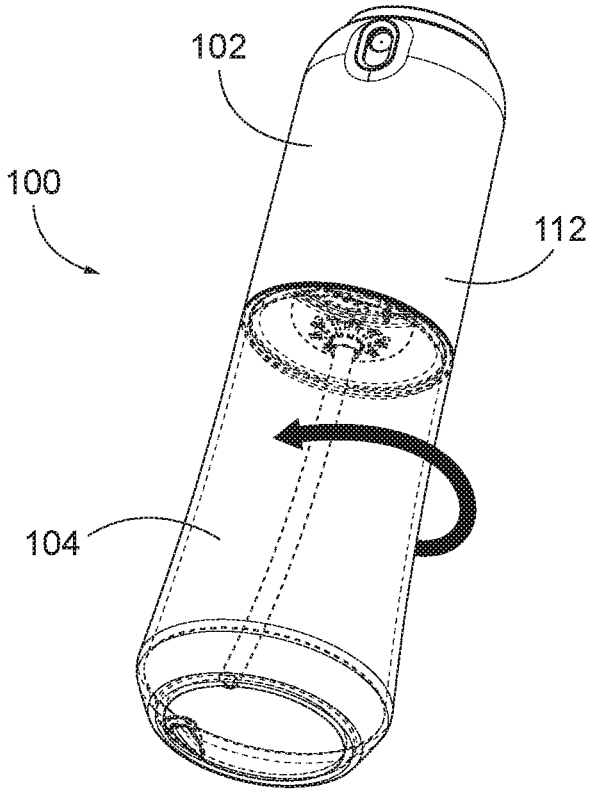
FIG. 34 is a perspective view of the spray device in a first step of disassembly with the bottle portion.
Figure 35:
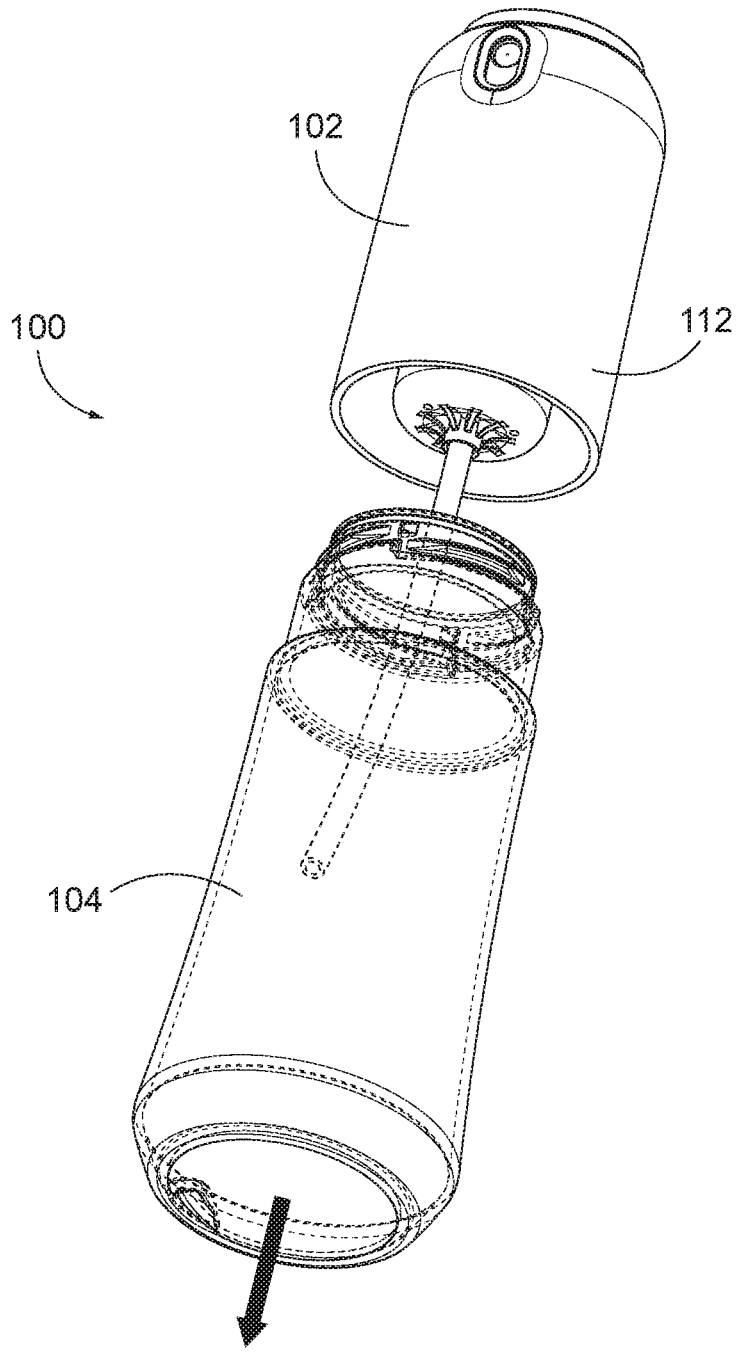
FIG. 35 is a perspective view of the spray device in a second step of disassembly with the bottle portion.

The bottle portion 104 is replaceable to the remainder of the spray device 100. The bottle portion 104 is removed from the spray device 100 by twisting the bottle portion 104 relative to the sleeve 112 in a direction opposite from when the spray device 100 is charging a dose of liquid spray as shown in FIG. 34, and pulling the bottle portion 104 from the sleeve 112 as shown in FIG. 35. The spray device 100 requires a torque to screw the cup 150 onto the bottle portion 104 that is less than a torque required for charging a dose of liquid spray in the spray device 100. This allows for assembly of the cup 150 and the bottle portion 104 without charging the spray device 100.

Figure 36:
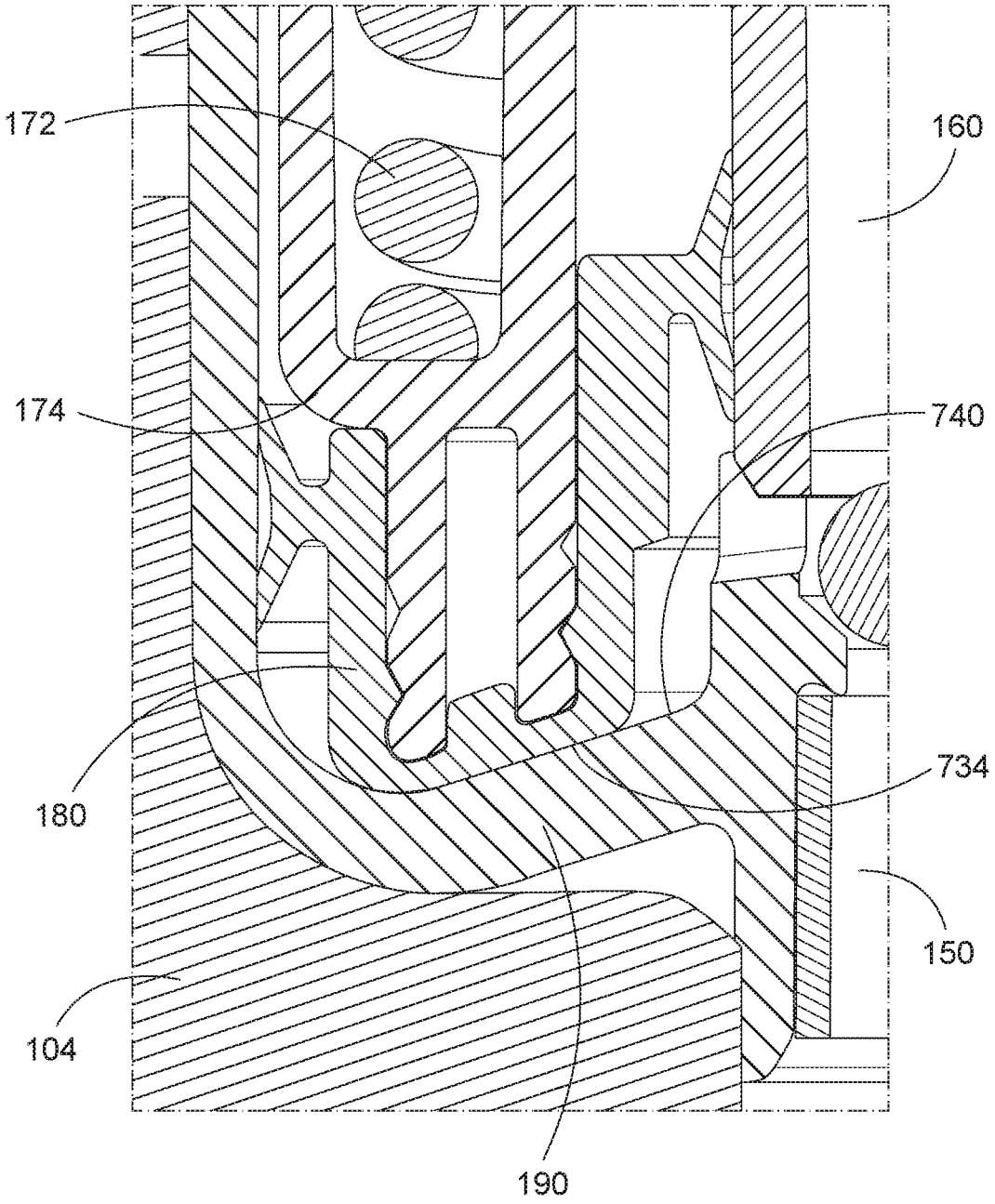
FIG. 36 is a partial cross-sectional front view of the spray device.

Alternative spray device 100 designs may be employed to bring an abrupt end to dispensing a dose of liquid spray. FIG. 36 depicts an embodiment of the spray device 100 where the piston 180 is an end stop. To this end, as depicted, the piston 180 ends dispensing of a dose of liquid spray by contacting the cup bottom 190 such that the main spring 172 cannot pressurize the liquid spray. As depicted, a piston bottom surface 734 is substantially flat with an incline toward the cup bottom 190 about the spray device longitudinal axis 114, and the cup bottom 190 includes a cup bottom upper surface 740 that is complementary to the piston bottom surface 734, the cup bottom upper surface 740 being flat with a radial incline away from the piston 180 about the spray device longitudinal axis 114.

Figure 37:
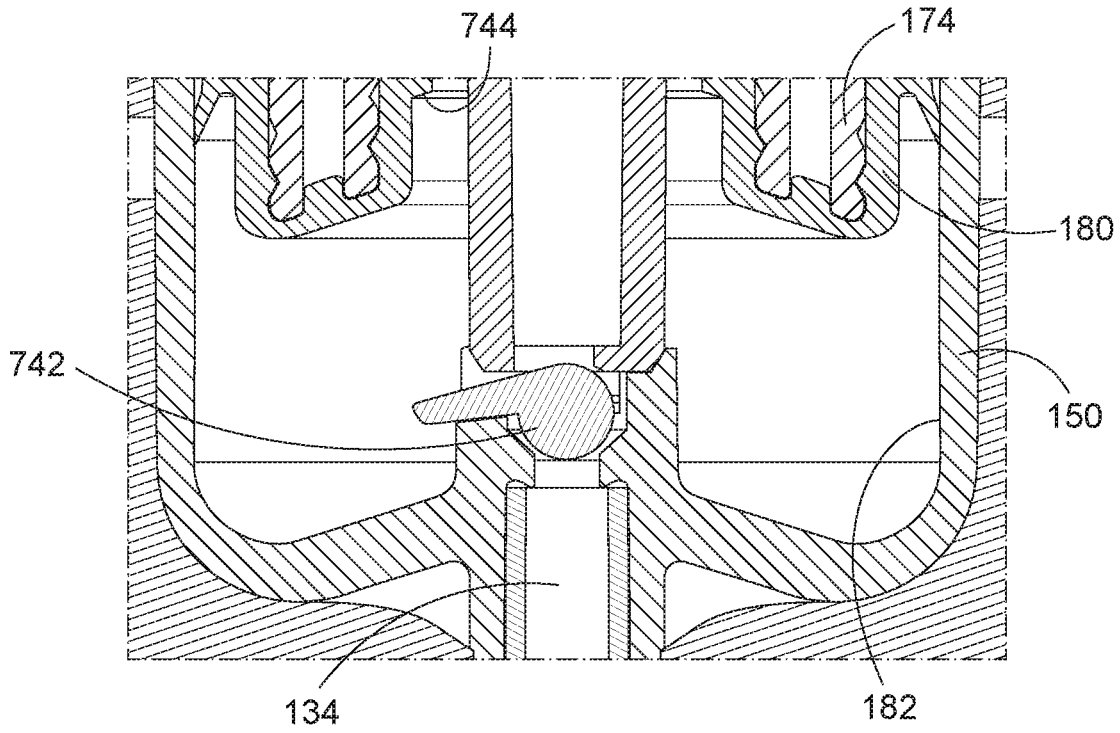
FIG. 37 is a partial cross-sectional front view of the spray device according to another embodiment.
Figure 38:
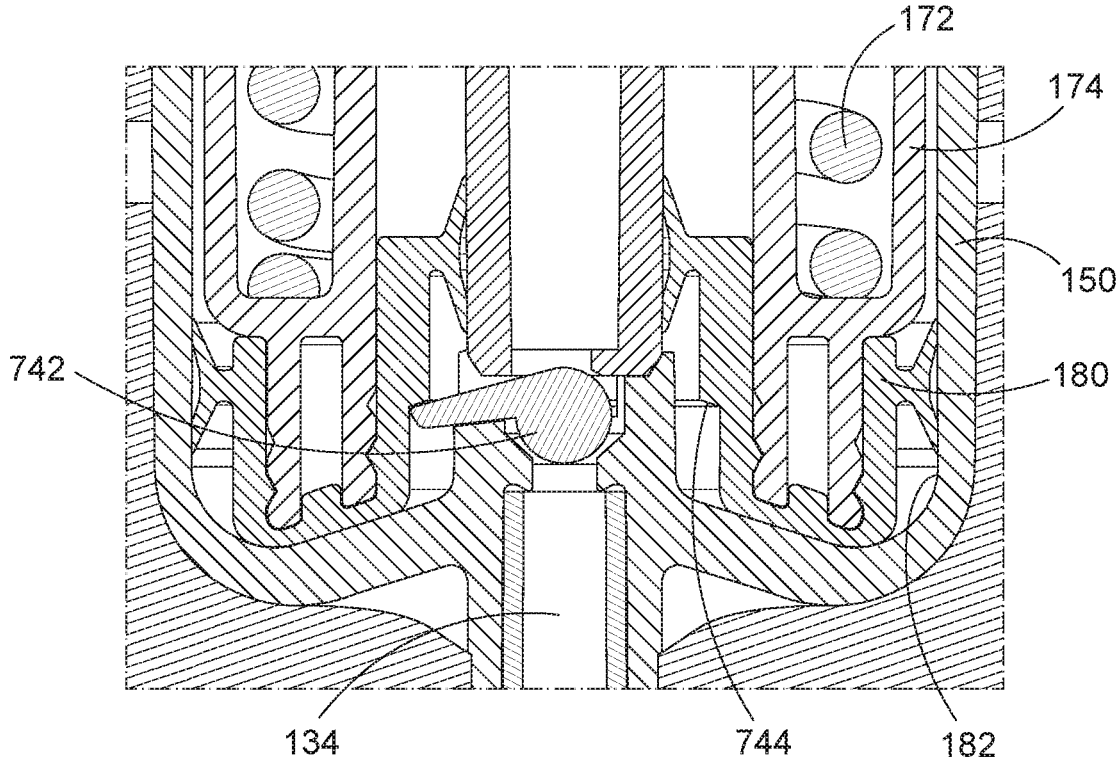
FIG. 38 is a partial cross-sectional front view of the spray device of FIG. 37.

FIGS. 37 and 38 depict an alternative embodiment of the spray device 100 where the ball 184 is replaced with an exhaust valve 742 configured to allow liquid spray to enter the chamber 182 from the dip tube 134, and prevent liquid spray from exiting the chamber 182 to the dip tube 134. To this end, the exhaust valve 742 is configured for actuating from an open position to a closed position, and maintain the closed position from a start of dispensing liquid spray depicted in FIG. 37, to an end of dispensing liquid spray depicted in FIG. 38. When the exhaust valve 742 is actuated in the open position, a flow path for liquid spray is open through the exhaust valve 742 to allow liquid spray to travel from the dip tube 134 to the chamber 182. The end of dispensing liquid spray occurs when the piston 180 is actuated downward such that a piston ledge 744 engages the exhaust valve 742 and the cup 150, and actuates the exhaust valve 742 into the closed position by pressing sufficiently downward on the exhaust valve 742.

Figure 39:
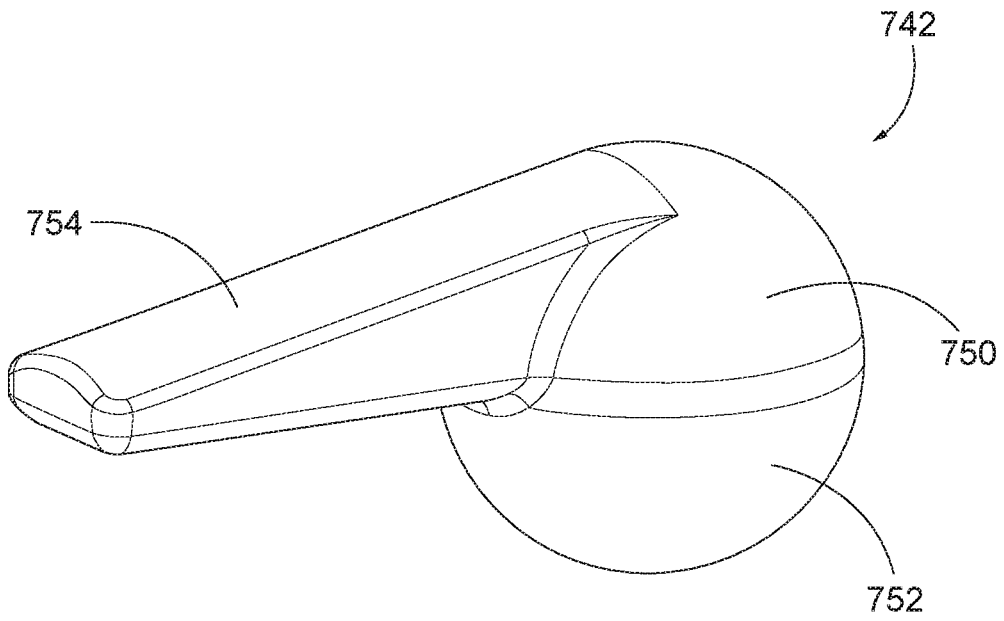
FIG. 39 is a perspective view of an exhaust valve of the spray device of FIG. 37.

As depicted in FIG. 39, the exhaust valve 742 is formed from an exhaust valve ball 750 including a ball exhaust valve sealing surface 752 and a tail 754. The ball exhaust valve sealing surface 752 creates a seal with the cup 150 when the exhaust valve 742 is seated in the cup 150. The tail 754 extends radially outward from the exhaust valve 742, and is configured for being pressed by the piston 180 so as to actuate the exhaust valve 742 into the closed position, and otherwise pressed by fluid pressure in the liquid spray so as to actuate the exhaust valve 742 into the open position. As such, an end of dispensing liquid spray occurs when the tail 754 is actuated sufficiently downward by the piston ledge 744 so as to actuate the exhaust valve 742 into the closed position.

An embodiment alternative to the ball 184 and the exhaust valve 742 embodiments depicted in FIGS. 36-39 is a valve formed through screw orifices. In the embodiment, the screw orifices are formed through laser drilling.

Figure 40:
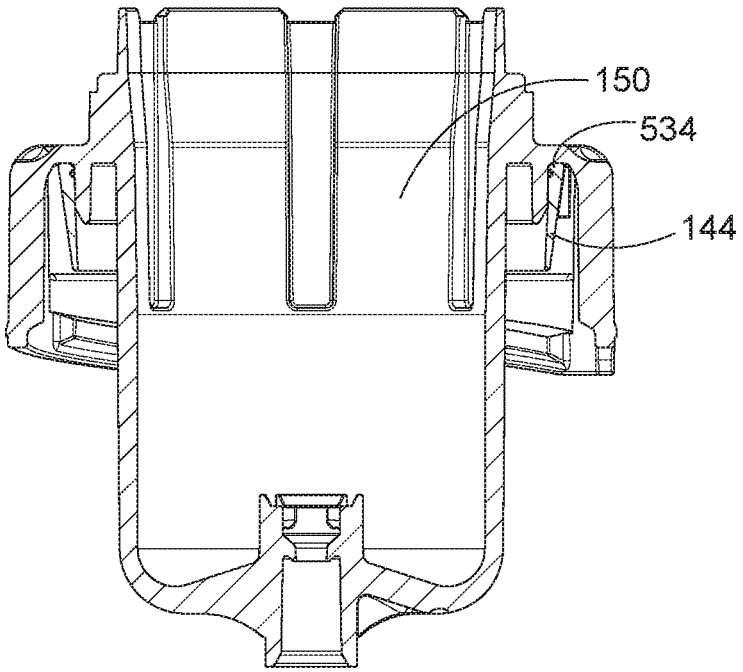
FIG. 40 is a cross-sectional front view of the spray device in a step of assembly.
Figure 41:
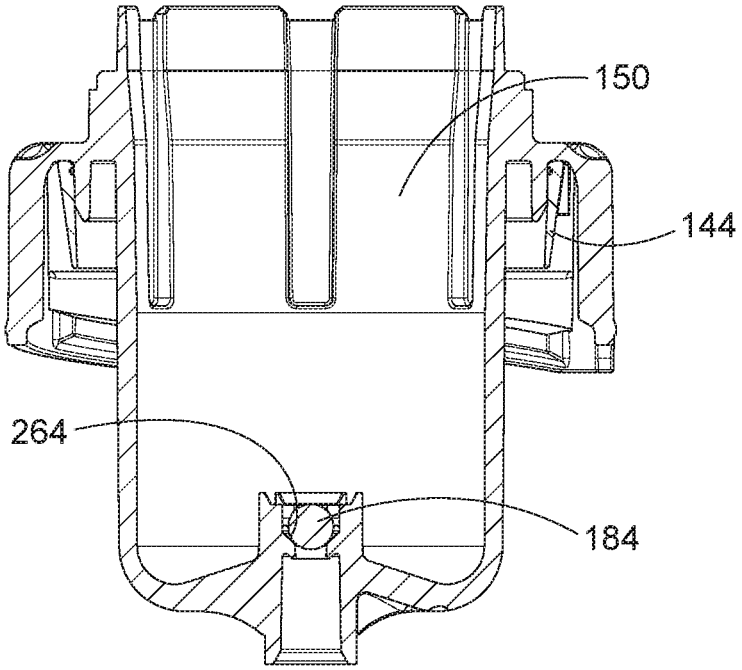
FIG. 41 is a cross-sectional front view of the spray device in a step of assembly.
Figure 42:
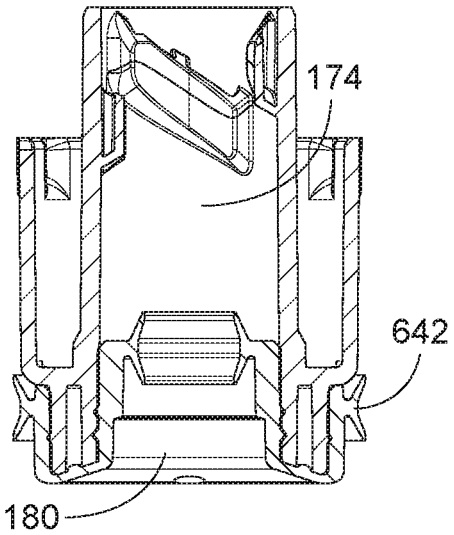
FIG. 42 is a cross-sectional front view of the spray device in a step of assembly.
Figure 43:
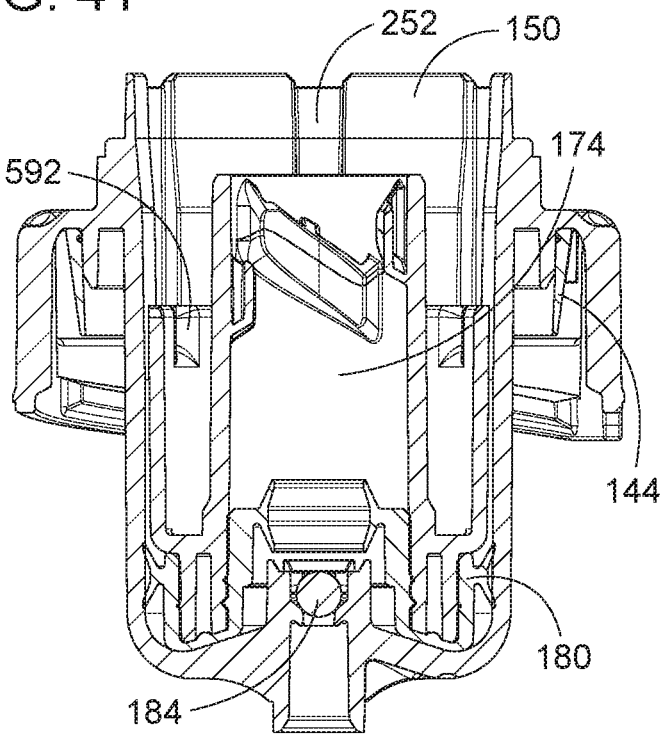
FIG. 43 is a cross-sectional front view of the spray device in a step of assembly.

FIGS. 40-51 depict steps in a method of assembling the spray device 100. FIG. 40 depicts the vent 144 assembled with the cup 150, where the vent detent 354 catches the cup 150, fixing the vent 144 with the cup 150. Notably, no rotational alignment between the cup 150 and the vent 144 is required for assembling the cup 150 and the vent 144. FIG. 41 depicts the ball 184 dropped in the cup 150, seated on the cup ball valve seating 264. A next step in the method of assembling the spray device 100 includes assembling the piston 180 with the nut 174 as depicted in FIG. 42, and lubricating the piston outer flat 642 before assembling the piston 180 and the nut 174 with the cup 150 as depicted in FIG. 43. As depicted, the nut 174 and the cup 150 have complementary features in the at least one cup wall track 252 and the at least one nut outer wall ridge 592 which, when engaged, maintain a rotational alignment between the nut 174, the piston 180, and the cup 150.

Figure 44:
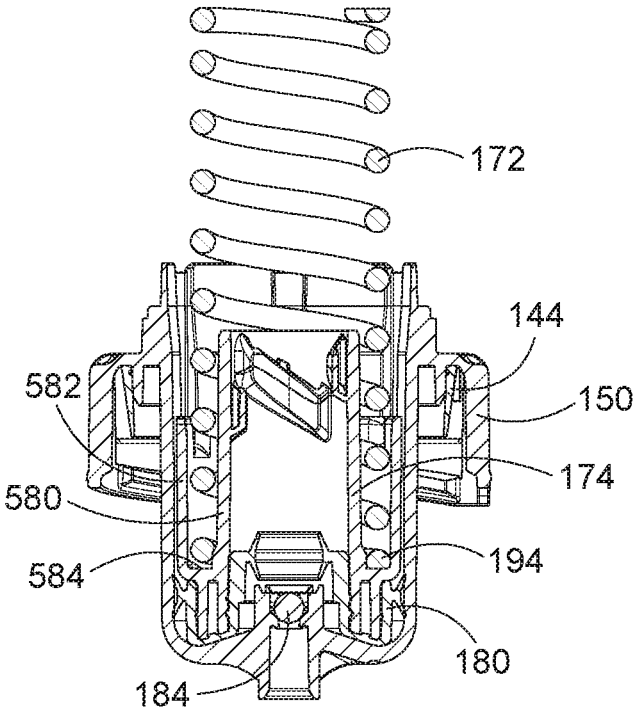
FIG. 44 is a cross-sectional front view of the spray device in a step of assembly.
Figure 45:
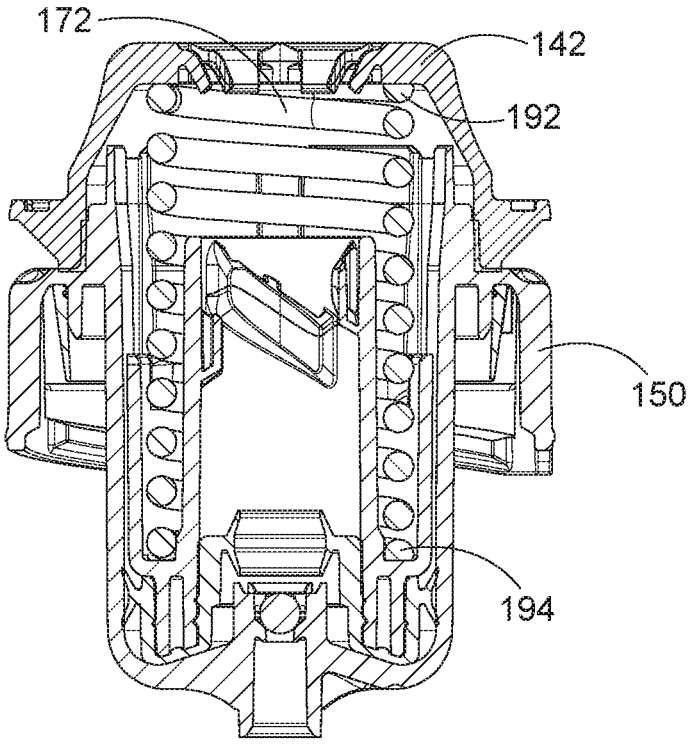
FIG. 45 is a cross-sectional front view of the spray device in a step of assembly.

FIG. 44 depicts the main spring 172 uncompressed and dropped in the nut 174 such that the spring bottom end 194 is seated on the nut floor 584, between the nut inner wall 580 and the nut outer wall 582. A lubricant is applied to the main spring 172 or the cap 142 at the cap bottom face 300 where the main spring 172 contacts the cap 142. As depicted in FIG. 45, the cap 142 is lowered onto the main spring 172 and the cup 150, compressing the main spring 172 such that the main spring 172 is prestressed in the spray device 100. The cup 150 and the cap 142 are spin welded together, forming a single unitary piece containing the main spring 172. In an embodiment of the assembly method, the cup 150 and the cap 142 are actively cooled after being spin welded together. The spring top end 192 and the spring bottom end 194 are ground to respectively mate with the cap 142 and the nut 174. In an embodiment, the main spring 172 has a free length/diameter ratio of approximately 3.95, however a variety of length/diameter ratios may be employed in the main spring 172 without departing from the scope of the present disclosure.

Figure 46:
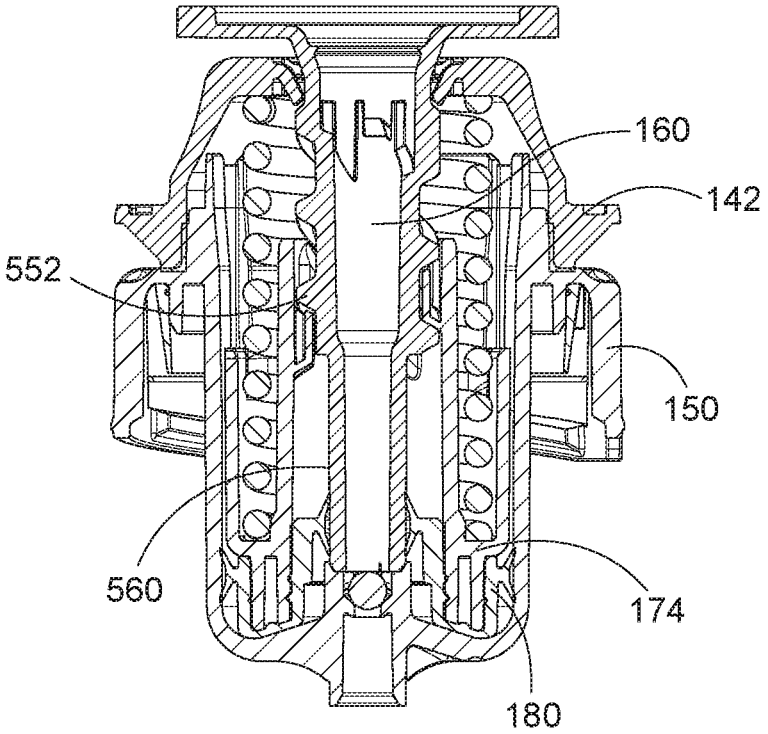
FIG. 46 is a cross-sectional front view of the spray device in a step of assembly.
Figure 47:
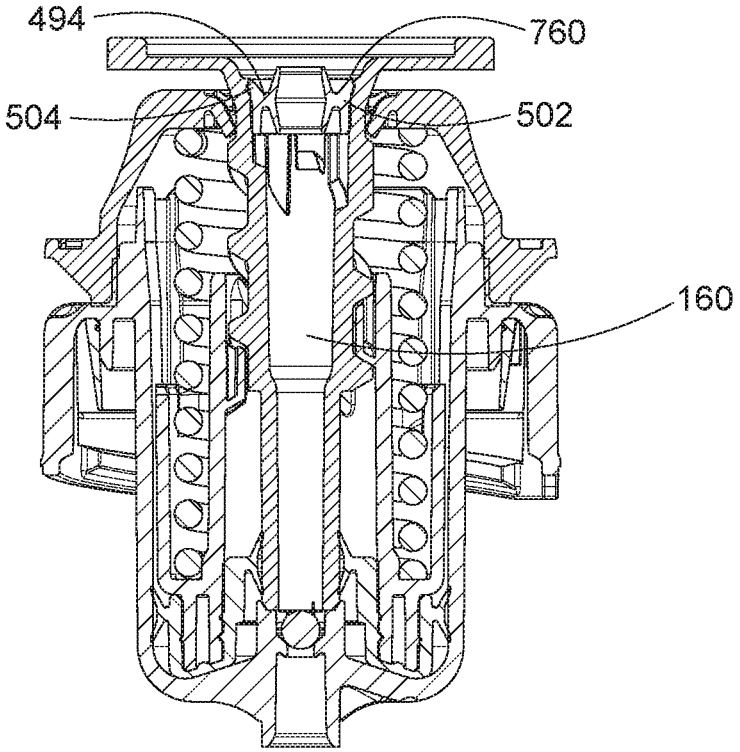
FIG. 47 is a cross-sectional front view of the spray device in a step of assembly.

FIG. 46 depicts the screw 160 assembled with the cup 150, the piston 180, the nut 174, and the cap 142. Before the screw 160 is inserted through the cap 142, the nut 174, and the piston 180, the screw threading 552 and the screw sealing face 560 are lubricated. FIG. 47 depicts the valve 494 inserted into the screw 160, with the valve outer wall 502 forming a seal with the screw sealing surface, where the valve 494 is fixed relative to the screw 160 with a valve detent 504 that catches a screw detent 760 complementary with the valve detent 504.

Figure 48:
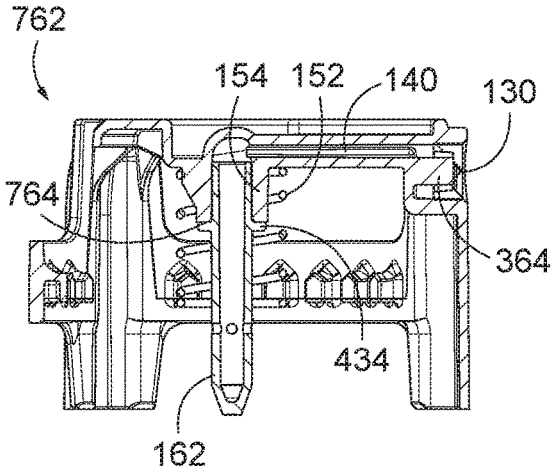
FIG. 48 is a cross-sectional front view of the spray device in a step of assembly.

FIG. 48 depicts a spray channel subassembly 762 formed from the spray channel 140 assembled with the nozzle 130, the stem 162, and the return spring 152. As depicted, the stem 162 is inserted into the stem inlet 154 until the stem flange 434 abuts a spray channel bottom end face 764. The return spring 152 is seated on the spray channel bottom end face 764 around the stem 162, and the nozzle 130 is inserted onto the nozzle boss 364.

Figure 49:
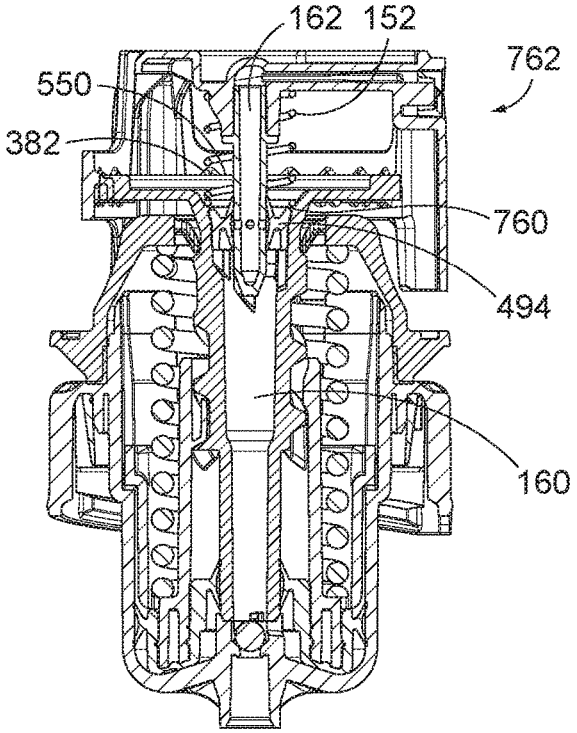
FIG. 49 is a cross-sectional front view of the spray device in a step of assembly.

The spray channel subassembly 762 is assembled with the valve 494 and screw 160 in FIG. 49. As depicted, the stem 162 is inserted into the valve 494, the return spring 152 is seated in the screw 160, resting on the screw detent 760, and the at least one spray channel clutch tooth 382 is fitted with the at least one screw clutch tooth 550.

Figure 50:
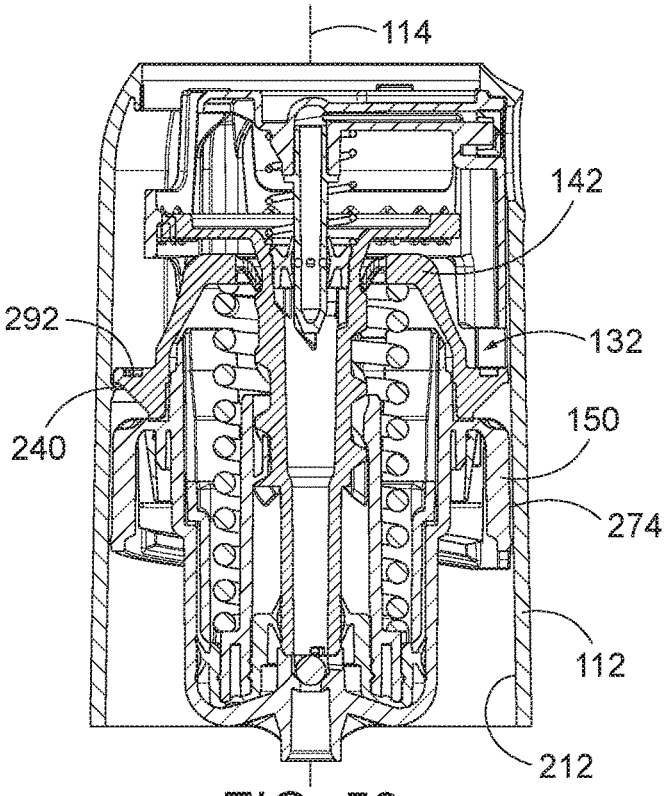
FIG. 50 is a cross-sectional front view of the spray device in a step of assembly.
Figure 51:
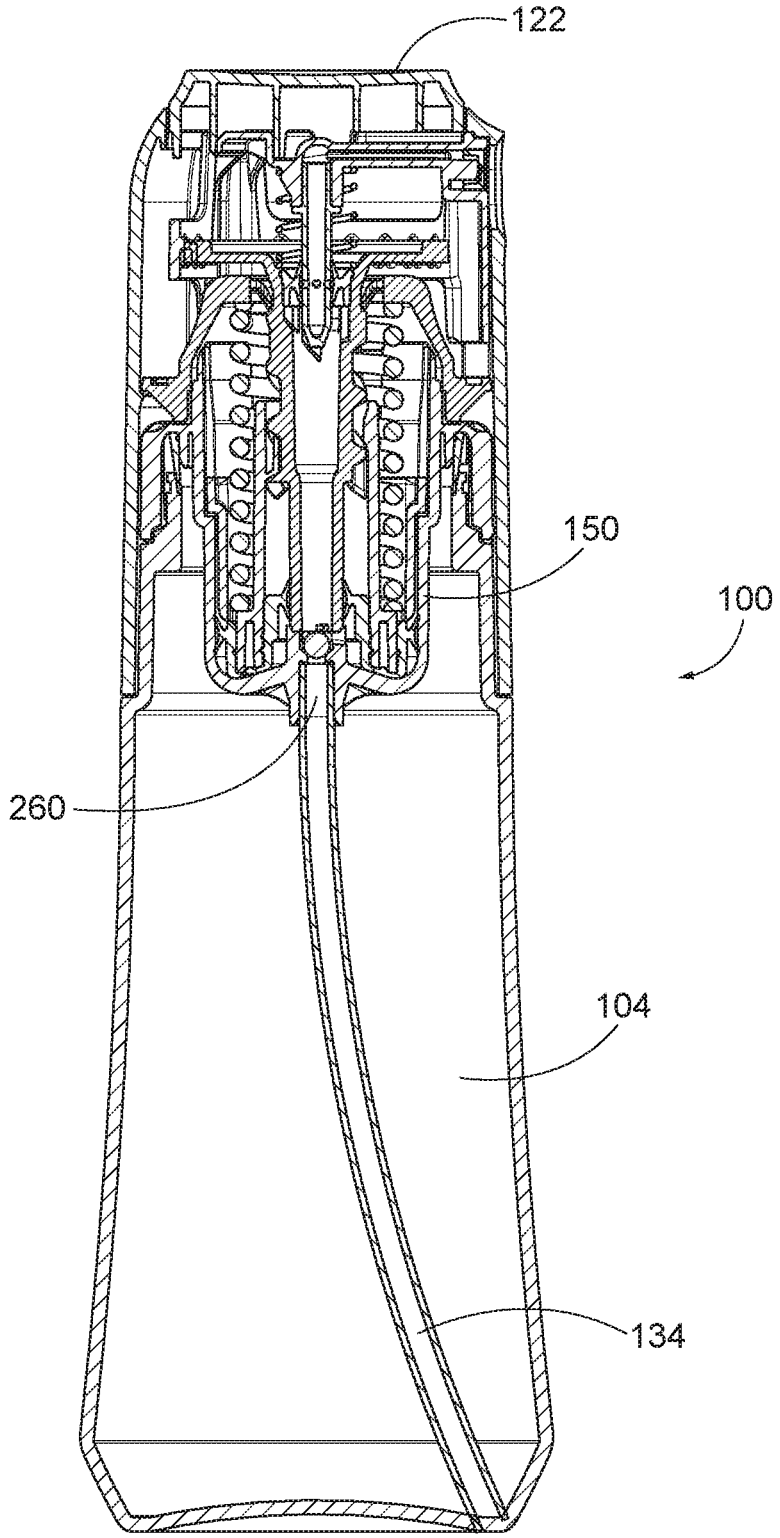
FIG. 51 is a cross-sectional front view of the spray device assembled.

FIG. 50 depicts the sleeve 112 assembled with the engine 132. As depicted, the at least one sleeve bearing 274 contacts the sleeve inner surface 212 so as to fix the cup 150 in a radial position with the sleeve 112, with respect to the spray device longitudinal axis 114. Also, the upper bearing detent 240 catches the cap flange 292, fixing the cap 142 in a longitudinal position with respect to the sleeve 112. FIG. 51 depicts an assembled spray device 100, where the dip tube 134 is inserted into the dip tube inlet 260, and the bottle portion 104 fixed to the cup 150, over the dip tube 134.

Figure 52:
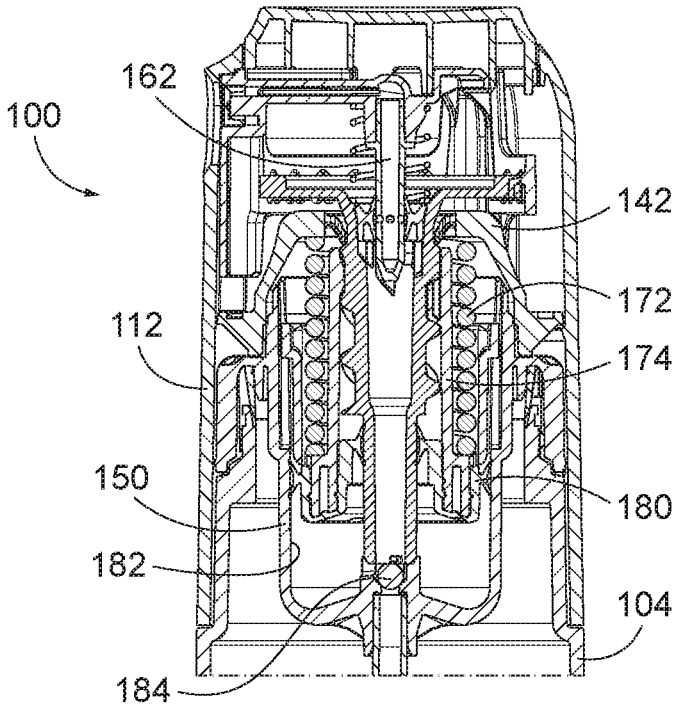
FIG. 52 is a partial cross-sectional side view of the spray device in a charged state.
Figure 53:
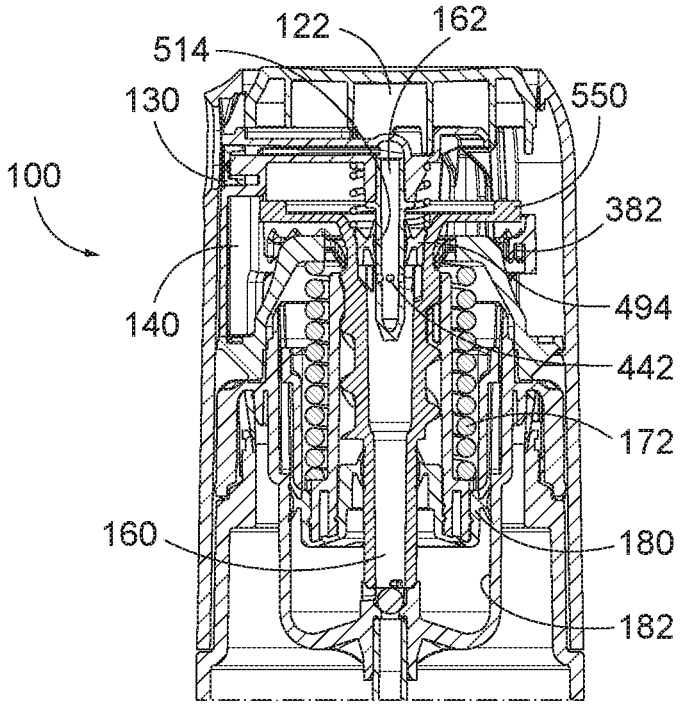
FIG. 53 is a partial cross-sectional view of the spray device with the button depressed into the spray device.
Figure 54:
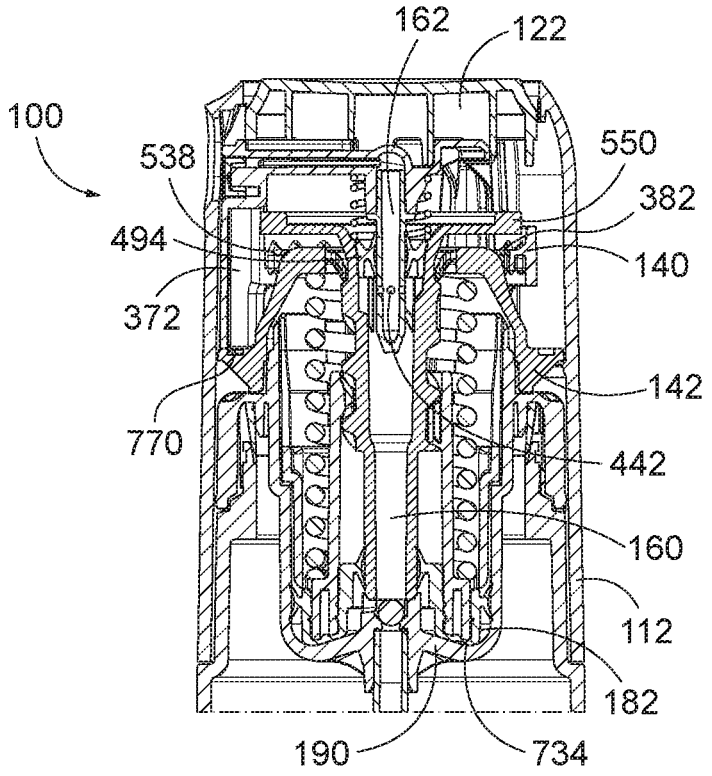
FIG. 54 is a partial cross-sectional view of the spray device in a dispensed stated.

FIGS. 52-54 depict a method of charging and dispensing a dose of liquid spray with the spray device 100. As depicted in FIG. 52, the sleeve 112 is rotated relative to the bottle portion 104 such that the main spring 172 is compressed and presses the piston 180 and the nut 174 against the cap 142. The nut 174 and the piston 180 are also driven to slide along the cup 150 such that the piston 180 draws a dose of liquid spray, as a dispensable amount of fluid, into the chamber 182. In this manner, a torque applied to the engine 132 that compresses the main spring 172 draws a dispensable amount of fluid into the chamber 182.

As also depicted in FIG. 52, the ball valve formed between the ball 184 and the cup 150 is closed and prevents liquid spray from returning to the bottle portion 104 from the chamber 182. Because the valve 494 is closed with the stem 162, liquid in the chamber 182 cannot leave and the piston 180 remains stationary. Under these circumstances, a dose of liquid spray in the spray device 100 is charged. The at least one bottle portion stop 732 prevents excessive compressing of the main spring 172 and consequential overcharging the spray device 100. Notably, aspects of the charge torque, pressure in the cup, compressive force required by the button, and volume of liquid spray dispensed are exemplary and can be modified without departing from the scope of the present disclosure.

As depicted in FIG. 53, the button 122 is pressed downwards, disengaging the at least one spray channel clutch tooth 382 and the at least one screw clutch tooth 550. When the button 122 is pressed, the spray channel 140 presses the stem 162 downward through the valve 494, pressing the at least one stem orifice 442 beyond the valve inner wall interior surface 514 and opening a flow path for the liquid spray through the stem 162. With a flow path from the chamber 182 to the nozzle 130 open, pressure from the main spring 172 actuates the piston 180 to contract the chamber 182 and dispense a dose of liquid spray through the screw 160, the stem 162, the spray channel 140, and the nozzle 130. Because the button 122 may be released at any time, when the screw 160 may be at any point of rotation relative to the spray channel 140, the at least one spray channel clutch tooth 382 is configured to engage the at least one screw clutch tooth 550 at any relative rotational angle to facilitate a return of the button 122 to an extended position.

As shown in FIG. 54, dispensing the liquid spray ends when the piston bottom surface 734 contacts the cup bottom 190, ending the pressure exerted on the chamber 182 by the main spring 172. Dispensing the liquid spray may also end when a user stops pressing the button 122, which repositions the at least one stem orifice 442 back in the valve 494, sealing fluid flow between the stem 162 and the screw 160. A process of depressing the button 122 from the extended position begins with disengaging the at least one screw clutch tooth 550 from the at least one spray channel clutch tooth 382, which allows the screw 160 to rotate relative to the spray channel 140, allowing the main spring 172 to drive the nut 174 and by extension the piston 180 downwards, contracting the chamber 182. The spray device 100 is configured to disengage the at least one screw clutch tooth 550 from the at least one spray channel clutch tooth 382 before uncovering the at least one stem orifice 442 from under the valve 494 with respect to the screw 160. Uncovering the at least one stem orifice 442 opens a flow path from the chamber 182 to the nozzle 130. When the button 122 is fully depressed, the spray channel 140 bottoms out on the cap 142, where a spray channel leg bottom end 770 of the at least one spray channel leg 372 abuts the cap 142.

Figure 55:
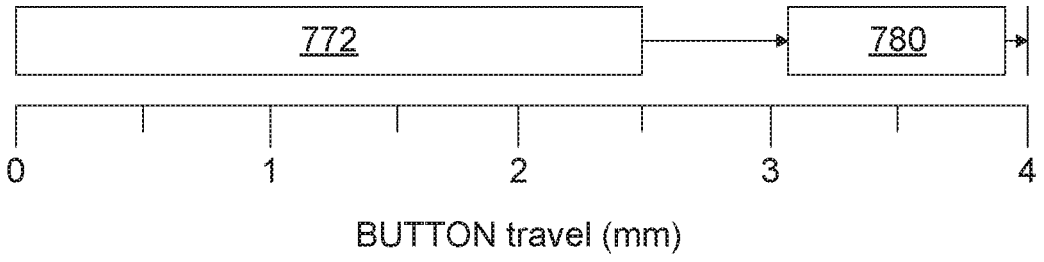
FIG. 55 depicts a travel sequence of the button when the button is depressed.

FIG. 55 depicts a travel sequence of the button 122 corresponding with disengaging the at least one screw clutch tooth 550 from the at least one spray channel clutch tooth 382. As depicted in a first sequence of button movement 772, the button 122 takes a total travel distance of approximately 4 mm between the extended position and a bottomed out position. Disengaging the at least one screw clutch tooth 550 from the at least one spray channel clutch tooth 382 as the first sequence of button movement 772 occurs over the first approximate 2.5 mm of button 122 travel. The button 122 travels an additional approximate 0.6 mm as a clearance 774 to ensure the at least one screw clutch tooth 550 is fully disengaged from the at least one spray channel clutch tooth 382, and approximately 1.8 mm of additional button 122 travel is a second sequence of button movement 780 that corresponds with uncovering the at least one stem orifice 442 from under the valve 494. An additional 0.1 mm of button 122 travel occurs before the button 122 reaches the bottomed out position.

Figure 56:
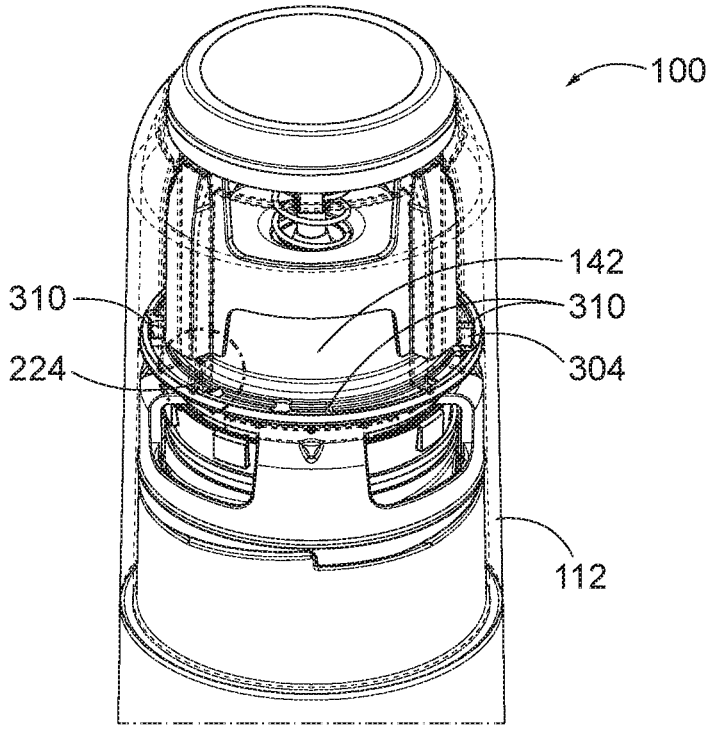
FIG. 56 depicts a partial perspective view of the spray device exposing a clicker device.
Figure 57:
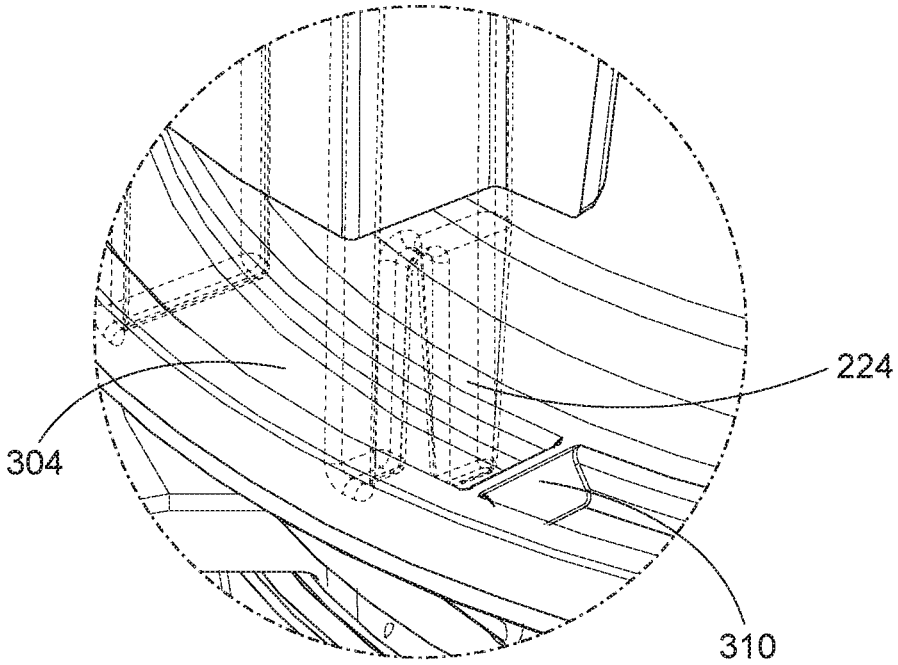
FIG. 57 depicts an enlarged section of FIG. 56 including the clicker device.

As shown in FIGS. 56 and 57, the clicker blade 224 and the at least one clicker rib 310 together form a clicker device that produces an audible click when the sleeve 112 rotates an incremental distance relative to the cap 142. With a click produced at each incremental distance traveled by the sleeve 112 relative to the cap 142, the clicker device indicates an extent to which the spray device 100 is charged, and how much liquid spray the spray device 100 is configured to dispense. Notably, the sleeve 112 and the cap 142 do not rotate relative to each other when the liquid spray is being dispensed, such that the clicker device does not produce audible clicks when liquid spray is being dispensed.

As depicted, the at least one clicker rib 310 is four clicker ribs disposed about the clicker channel 304, such that the clicker device may produce four audible clicks as the spray device 100 is being charged, however a different number of clicker blades 224 and clicker ribs 310 may be employed in the spray device 100 to produce a different number of audible clicks over a different range of rotation between the sleeve 112 and the cap 142, without departing from the scope of the present disclosure.

Figure 58:
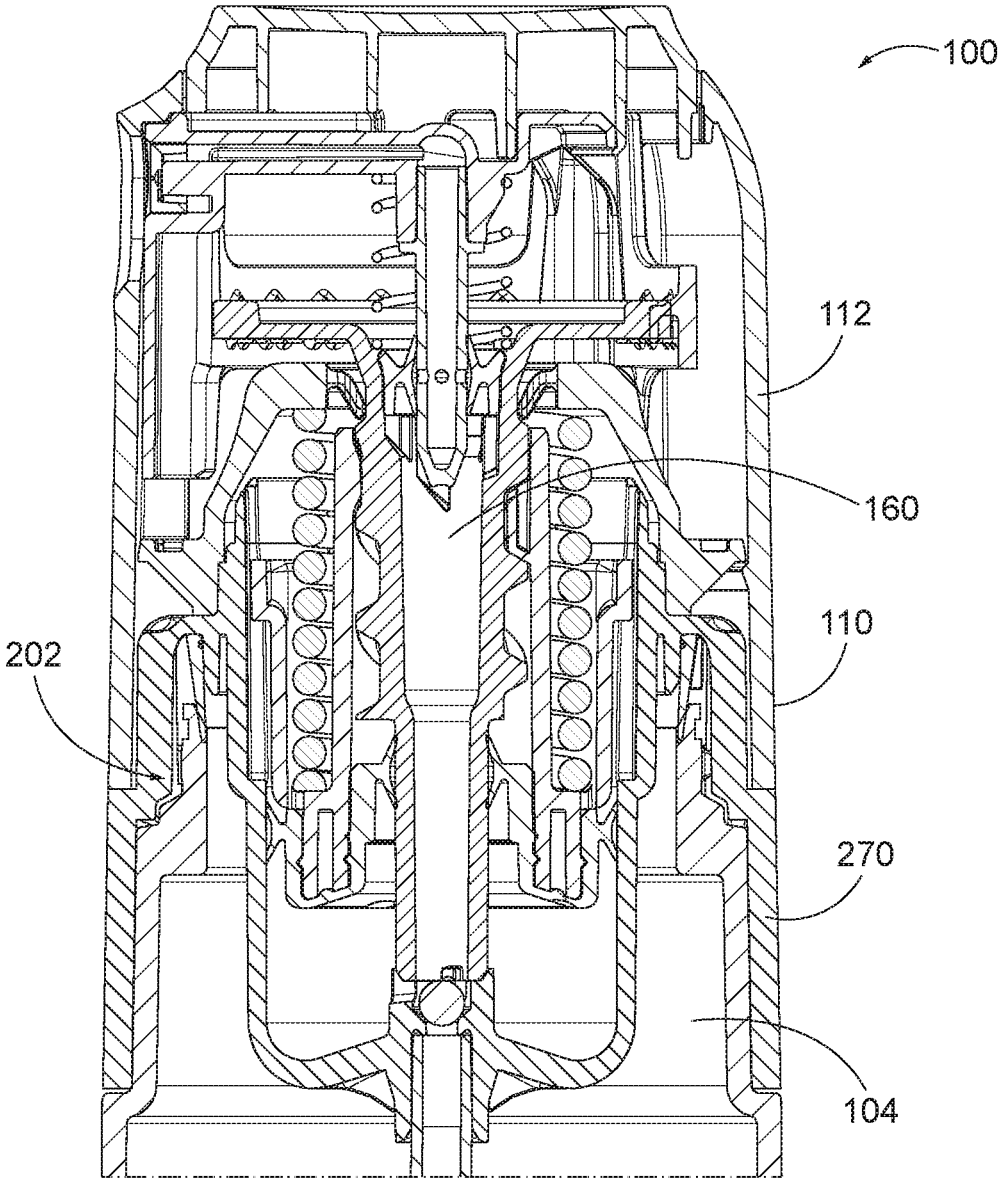
FIG. 58 depicts partial cross-sectional view of the spray device according to an alternative embodiment.

In an alternative embodiment of the spray device 100 depicted in FIG. 58, the at least one cup rib 270 is extended and configured for being exposed from under the sleeve 112 and forms part of the spray device exterior surface 110 with the bottle portion 104. With this construction, the at least one cup rib 270 is configured for being rotated about the spray device longitudinal axis 114 independent to the screw 160 and without applying torque to the engine 132, and is only linked with applied torque through the threaded section of the bottle portion top end portion 202. With this construction, it is possible to cap the spray device 100 after filling the bottle portion 104 without charging the spray device 100. Because the liquid spray does not require a propellant, the bottle portion 104 may be completely filled with liquid spray without leaving room for propellant in the bottle portion 104.

It will be appreciated that various embodiments of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A spray device comprising:

a bottle portion;

a sleeve; and an engine;

wherein the engine comprises a main spring that when compressed pressurizes a chamber containing a dispensable amount of fluid from the bottle portion, wherein the sleeve and the engine are configured to be torquable onto the bottle portion without compressing the spring, wherein the engine is selectively engageable with a spray channel configured to provide a clutch with the engine, selectively charge the engine, and to open a flow path from the chamber to a nozzle, and wherein the engine includes a screw engaged with the spray channel when a button is in an extended position, the screw and the spray channel being engaged between at least one spray channel clutch tooth and at least one screw clutch tooth.

2. The spray device according to claim 1, wherein the bottle portion includes a rotational stop configured to engage the engine as a rotational end stop when the engine is attached with the bottle portion.

3. The spray device according to claim 1, wherein depressing the button from an extended position to a bottomed out position includes depressing the button through:

a first movement sequence where the engine is disengaged from the spray channel;

a clearance; and a second movement sequence where a stem is pressed through a valve by the spray channel so as to open a flow path from the chamber to a nozzle.

4. The spray device according to claim 1, wherein a torque applied to the engine that compresses the main spring draws fluid into the chamber.

5. A spray device comprising:

a bottle portion;

a sleeve; and an engine;

wherein the engine comprises a main spring that when compressed pressurizes a chamber containing a dispensable amount of fluid from the bottle portion, wherein the sleeve and the engine are configured to be torquable onto the bottle portion without compressing the spring, wherein the engine includes a cup having a cup wall and at least one cup rib extended radially outward from the cup wall, and wherein the at least one cup rib forms part of a spray device exterior surface with the bottle portion.

6. The spray device according to claim 5, wherein the at least one cup rib is configured for being rotated about the spray device longitudinal axis without applying torque to the engine.

7. A spray device comprising:

a bottle portion;

a sleeve; and an engine;

wherein rotation of the sleeve relative to the bottle by a user pressurizes a chamber containing fluid from the bottle, wherein the sleeve is configured such that auditory and/or tactile feedback is provided to the user during rotation of the sleeve thereby allowing the user to select an amount of the fluid to be dispensed, wherein the sleeve further includes at least one sleeve rib disposed along the sleeve, the at least one sleeve rib being configured for constraining the engine in a rotational position with the sleeve during the rotation of the sleeve, and the clicker blade is disposed on a sleeve rib bottom portion of the at least one sleeve rib.

8. The spray device according to claim 7, wherein the sleeve includes a clicker blade extended toward the engine, the clicker blade being configured to produce at least one audible click with complementary features of the engine during the rotation of the sleeve.

9. The spray device according to claim 7, wherein the at least one sleeve rib is configured for engaging a spray channel which provides a clutch selectively engageable with the engine.

10. The spray device according to claim 7, wherein the sleeve is selectively engageable with the engine.

11. The spray device according to claim 7, further comprising a button, wherein:

the sleeve is engaged with the engine when the button is in an extended position; and the sleeve is disengaged from the engine when the button is in a bottomed out position.

12. A spray device comprising:

a bottle portion;

a sleeve; and an engine;

wherein the engine comprises a spring that when compressed pressurizes a chamber containing a dispensable amount of fluid from the bottle portion, wherein the spring is enclosed between a cup and a cap, which have been fused together, and wherein the cap includes holes for engagement of an associated spin-welding tool.

13. The spray device according to claim 12, wherein the cup and cap are fused together by spin-welding.

14. The spray device according to claim 12, further comprising a cap weld wall extended integrally from the cap toward the cup, surrounding and contacting a cup shoulder so as to form a weld surface between the cap and the cup.

15. The spray device according to claim 12, further comprising:

a nut axially constraining the spring in the cap and the cup; and a screw inserted in the engine and engaged with the nut, the screw being configured for driving the nut in a linear direction corresponding with rotation of the screw with the sleeve relative to the bottle portion, wherein linear motion of the nut compresses the spring, pressurizing the chamber.

16. The spray device according to claim 15, further comprising a piston fixed with the nut at a nut bottom end portion, wherein the screw, the cup, and the piston form the chamber.

17. The spray device according to claim 12, further comprising a ball seated in the cup, forming a one way ball valve that prevents fluid from returning to the bottle portion from the chamber.

* * * * *